US012144471B1

(12) United States Patent
Pickrell

(10) Patent No.: US 12,144,471 B1
(45) Date of Patent: Nov. 19, 2024

(54) TOILET

(71) Applicant: David J Pickrell, Centre Hall, PA (US)

(72) Inventor: David J Pickrell, Centre Hall, PA (US)

( * ) Notice: Subject to any disclaimer, the term of this patent is extended or adjusted under 35 U.S.C. 154(b) by 131 days.

(21) Appl. No.: 17/887,470

(22) Filed: Aug. 14, 2022

(51) Int. Cl.
*A47K 11/02* (2006.01)

(52) U.S. Cl.
CPC ..... *A47K 11/02* (2013.01)

(58) Field of Classification Search
CPC ..... A47K 11/02; A47K 11/026
USPC ..... 4/484
See application file for complete search history.

(56) References Cited

U.S. PATENT DOCUMENTS 3,471,871 A * 10/1969 Nociti ..... A61F 5/44 383/7
3,772,712 A * 11/1973 Renn ..... A47K 11/02 4/484
10,329,035 B2 * 6/2019 O'Coin ..... B65F 1/0006

FOREIGN PATENT DOCUMENTS

WO WO-2021144500 A1 * 7/2021 ..... A47K 11/02

* cited by examiner

*Primary Examiner* — Lauren A Crane
(74) *Attorney, Agent, or Firm* — John J. Elnitski, Jr.

(57) ABSTRACT

A toilet that includes a bag having closed side walls, closed bottom and open top. The side walls and bottom form an enclosed interior to collect the solid and liquid waste. The toilet includes a filter attached to an interior surface of the bottom of the bag. The filter allows the liquid waste to flow through the filter, while trapping and removing unwanted particles and contaminants from the liquid waste. The toilet includes perforations in the side walls of the bag adjacent to the filter to allow the liquid processed through the filter to flow from the bag. The toilet includes a compactor bag receptacle having closed side walls, closed bottom and an open top, the side walls and bottom joined at edges to form a tank. The open top of the receptacle receives the bag. The receptacle is shaped to receive the bag and provide support for the bag.

16 Claims, 26 Drawing Sheets

TOILET

BACKGROUND

The field of invention generally relates to toilets. More specifically, the present invention relates to toilets that reduce waste volume and odor.

Portable toilets are commonly used in remote applications such as camping, hiking, fishing, off grid living, etc. These toilets can be hand carried by people staying in a remote area with just a tent. There are also hand carried or permanently installed versions in camping vehicles such as truck campers, travel trailers and recreational vehicles.

For hand carried toilets, one simple design uses a toilet seat which is supported above a plastic bag, so the user can urinate or defecate directly into a plastic bag. One version of these toilets utilizes a folding toilet seat with legs that the plastic bag is attached under to catch the feces and urine. Alternatively, some designs use a five-gallon plastic bucket that has a toilet seat which snaps onto the top of the bucket. A small trash bag is placed inside the bucket before the toilet seat is attached to collect the feces and urine. For these plastic bag-based toilets, the user can then simply remove the bag, tie it shut and dispose of the bag holding the waste products. These toilets have advantages of being cheap to acquire and use. They do not have a toilet bowl that needs cleaned and they don't require any electrical power or venting. For these types of toilets to be used repeatedly, the user needs to change the bag after each use or add water as well as deodorants and other chemicals before repeated use to reduce odors. Changing the bag after each use is time consuming, more costly and creates more plastic waste discarded into the environment. Adding water to the bag greatly increases the volume of waste that needs to be stored and disposed, which complicates handling, storage and disposal of the waste. If used in a camping or recreational vehicle, the toilet must be tightly sealed and secured to minimize the chance of the bucket falling over or liquid splashing out during travel. Adding to the cost and complexity of using the toilet is the addition of chemicals such as deodorants, disinfectants and in some cases agents to cause the water to gel in order to ease handling and disposal. Many toilets actually use double bags to minimize the chance of leakage, but this adds to the cost and the volume of plastic discarded into the environment. These toilets do not reduce the weight or volume of the waste products in any way. The waste remains at the same weight and volume if the bag is changed after each use or there is an increase of volume of the waste by adding water and other chemicals.

To eliminate time-consuming manual process of sealing the bag and inserting a new one with plastic bag toilets, there is a toilet mechanism that automatically seals the plastic bag off to contain the waste and its odors and introduces a new bag for the next use. This toilet uses a long continuous plastic bag on a roll that is inserted into the toilet before use. The user urinates or defecates into the first section of the continuous bag and then flushes the toilet. The toilet mechanism then uses an electric motor that creates a twisting action to seal that section of the continuous bag with waste products in it. The toilet mechanism unravels the plastic bag roll to expose a new section of the bag to be used. Disadvantages of this toilet are the requirement of electrical power and expensive of initial purchase and of replacement bags. It also requires flushing after every use. This adds to the cost to use the toilet and creates a more plastic waste. Similar to the simple plastic bag toilets, this type of toilet does not reduce the weight or size of the waste products.

For toilets permanently installed in camping and recreational vehicles, the most common toilet uses water to flush waste products from a toilet bowl in a similar manner to how toilets work in a house. A person uses the portable toilet water and flushes the waste products from the toilet bowl into a black water holding tank on the camper or recreational vehicle. These black water holding tanks have a finite capacity, so the user is limited in the amount the toilet can be flushed before the black water holding tank needs emptied. Even if the black water holding tank is not filled, it still needs emptied periodically to keep the system operating properly. The black water holding tanks are emptied from the camper or recreational vehicle only in designated waste dumping stations by physically moving the camper to the dump station and using a drain hose from the camper to empty it. This is a time consuming and very unpleasant task because of the mess and foul odors. To eliminate the need to drive to a dump station, cartridge toilets were developed for campers and recreational vehicles. These toilets use a small black water cartridge located just below the toilet to collect the human waste. The cartridge is removable from the toilet when full, so it can be carried by hand to a dump station. The cartridge can also be emptied into public bathrooms, which greatly expands the possible sites for emptying them. However, these toilets must be emptied much more often than water flush toilets that have conventional black water holding tanks.

A major disadvantage of water flush toilets is that during use they are substantially increasing the weight and volume of the waste products that need stored and disposed of by addition of the flushing water. In addition, by keeping them in liquid form they make the waste more difficult to handle during disposal, where the waste can splash and cause a foul-smelling mess. Another disadvantage is that they use fresh water to flush the waste products from the toilet bowl and fresh water is always limited and used sparingly on a camping vehicle because of the space it requires and weight it adds. To eliminate the need to have fresh water to flush the toilet and to have the waste products held in a solid form rather than liquid, composting toilets have been developed for campers and recreational vehicles. In these toilets the user defecates or urinates directly into a bed of compost and then a handle is rotated to mix the waste products with the compost. The compost is comprised of a mass of biodegradable material such as coconut coir, hemp stalks, peat moss, wood shavings, sawdust, etc. These toilets do create solid waste instead of liquid waste which is in many ways easier to store and dispose, but they also have inherent disadvantages. Again, the user is increasing the volume and weight of the waste products that must be handled, stored and then later disposed of by adding solid compost. In addition, since the bowl is not washed with water the waste products can accumulate on the bowl surface and need to be wiped off by hand by the user. In addition, foul odors can emanate from the compost and must be vented away. Some designs require the user to defecate in one compartment and urinate in another which complicates the process of using the toilet and the toilets are expensive.

The only type of commercially available portable toilet that actually reduces the size and weight of the human waste is an incinerating toilet. Incinerating toilets use propane gas or electricity to heat the waste products to a high temperature until they are burned into ash. The advantage of this toilet is that disposal of the waste products is easier since the ashes can be distributed on the ground. Emptying the ashes is much less unpleasant than emptying water based and composting toilets. One major disadvantage of the incinerating toilet is requirement of a lot of energy to operate. The average electric model uses 1.5 kWh per incineration cycle, which at two cycles per day is more energy than a typical refrigerator uses in a whole day. In remote applications electrical energy is in limited supply and must be provided by generators, batteries or solar cells. Another disadvantage is that the cycle times to incinerate the waste are around two hours, during which time the toilet cannot be used. In some cases, multiple incineration cycles are required to render the waste products completely to ash. A third disadvantage is the cost of these toilets, which can be three times that of even compositing toilets. Incinerating toilets also need the gases from the tank to be vented. The last major disadvantage is that the incinerating toilets need to be permanently installed with an electrical power hook-up and a vent.

It is an object to provide a toilet that reduces waste volume and odor.

SUMMARY OF THE INVENTION

A toilet that includes a bag having closed side walls, closed bottom and open top. The side walls and bottom form an enclosed interior to collect the solid and liquid waste. The toilet includes a filter attached to an interior surface of the bottom of the bag. The filter allows the liquid waste to flow through the filter, while trapping and removing unwanted particles and contaminants from the liquid waste. The toilet includes perforations in the side walls of the bag adjacent to the filter to allow the liquid processed through the filter to flow from the bag. The toilet includes a compactor bag receptacle having closed side walls, closed bottom and an open top, the side walls and bottom joined at edges to form a tank. The open top of the receptacle receives the bag. The receptacle is shaped to receive the bag and provide support for the bag.

DETAILED DESCRIPTION

The present invention is a toilet which provides an efficient method for capture, sealing, compaction, dehydration and storage of human waste. The first embodiment of the toilet is quick to set up, use and requires no plumbing, electrical or venting connections. It is low in both the initial cost and operating cost. The toilet requires no liquid, compost or propane gas to operate. The toilet uses a disposable bag to contain and seal off the waste. The toilet includes a reusable compactor that mechanically supports the bag. The toilet includes a method to remove liquid from the human waste and compact the human waste. The liquid is processed as it is removed.

Figure 1:
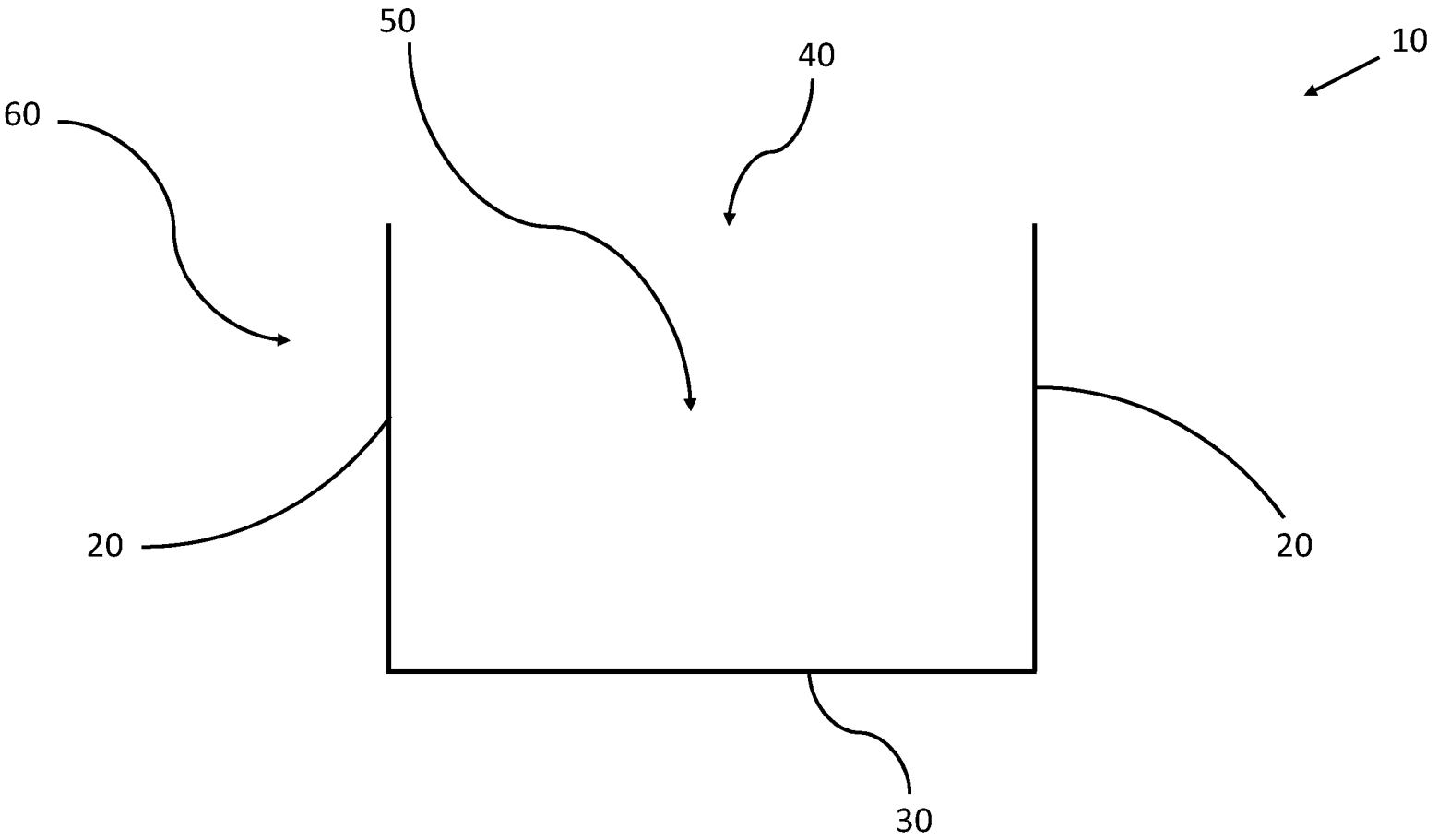
FIG. 1 is a schematic cross sectional view of components of the toilet according to the present invention.

FIG. 1 schematically shows the cross-section of a disposable bag 10. The bag 10 is typically rectangular, cubic or cylindrical in shape. The bag 10 has closed side walls 20, a closed bottom side 30 and an open top side 40. The side walls 20 and bottom side 30 are joined at the edges to form a continuous enclosed interior 50 and an exterior 60. Materials used to make the bag 10 can be plastic, rubber, wax paper, etc. that is impermeable to liquids and gases. Typically, the bag 10 is of a polypropylene or polyethylene. The bag 10 typically has a thickness of around 0.020 inches and the typical dimension of its bottom side 30 is approximately 1.5-2.0 feet in diameter if round or about 1.5×1.5 feet if square. Sides 20 of the bag 10 are typically approximately 2 feet in length from bottom side 30 to open top side 40 of the bag 10.

Figure 2:
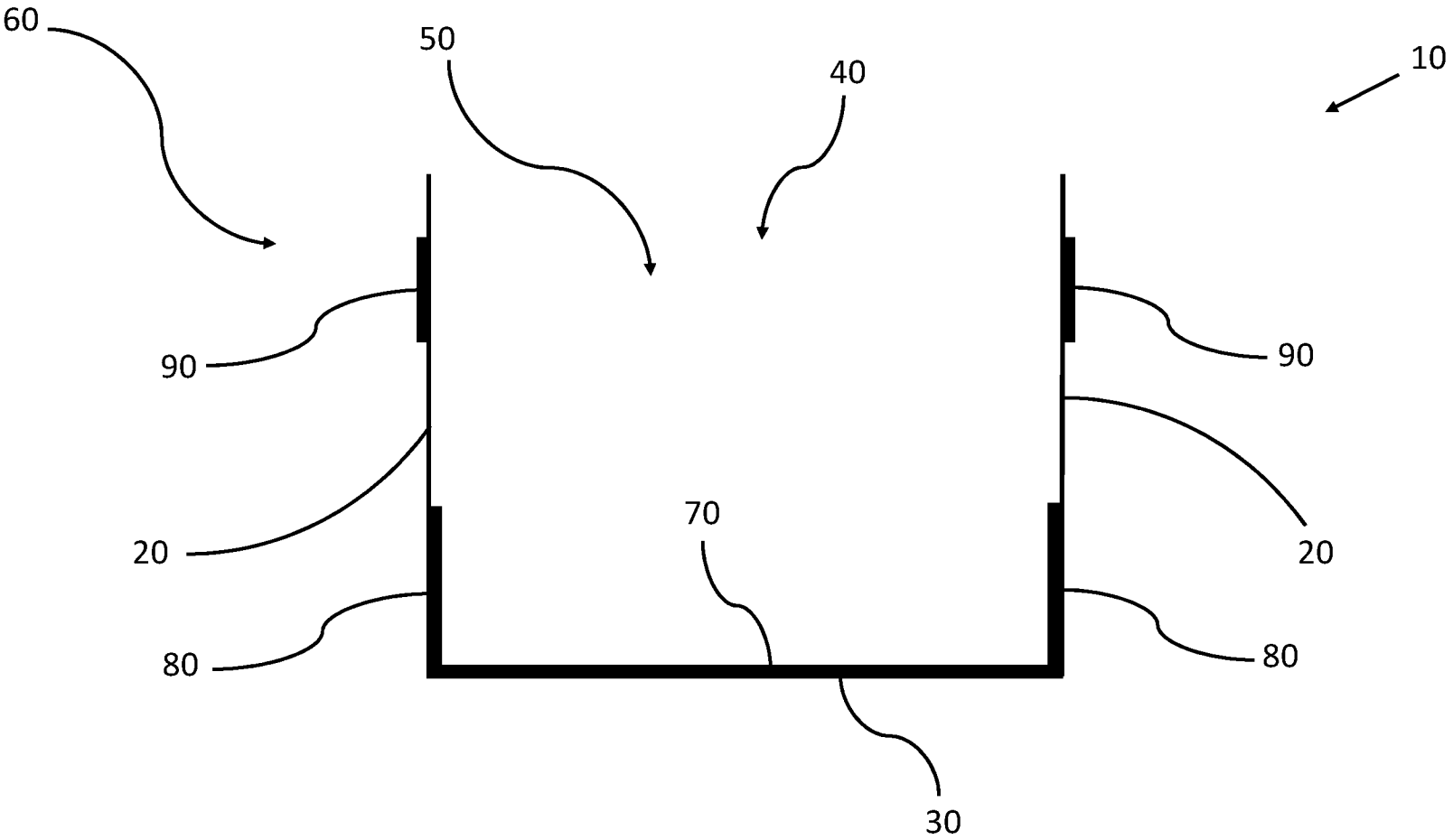
FIG. 2 is a schematic cross sectional view of components of the toilet according to the present invention.

FIG. 2 schematically shows other features of the bag 10 in addition to the walls. The first feature is a filter 70 that is attached to the surface of bottom side 30 on the interior 50 of the bag 10. The filter 70 also extends up along the side walls 20 from the bottom side 30. Filter 70 is a porous material that allows liquid to flow through while trapping and removing unwanted particles and contaminants from the liquid. Filter 70 is comprised of common materials found in commercial filters used to process liquid, such as filter paper, activated carbon, charcoal, etc. Filter 70 can also contain deodorizers, antimicrobial, antibacterial and other chemicals to chemically treat the liquid. Filter 70 can have a thickness of approximately ¼ inch or less, however, its area is very large relative to its thickness because the filter 70 covers the entire surface of the bottom side 30 of bag 10. Therefore, the typical area of filter 70 which covers bottom side 30 of bag 10 is a circle about 2 feet in diameter or a square about 1.5×1.5 feet.

Figure 3:
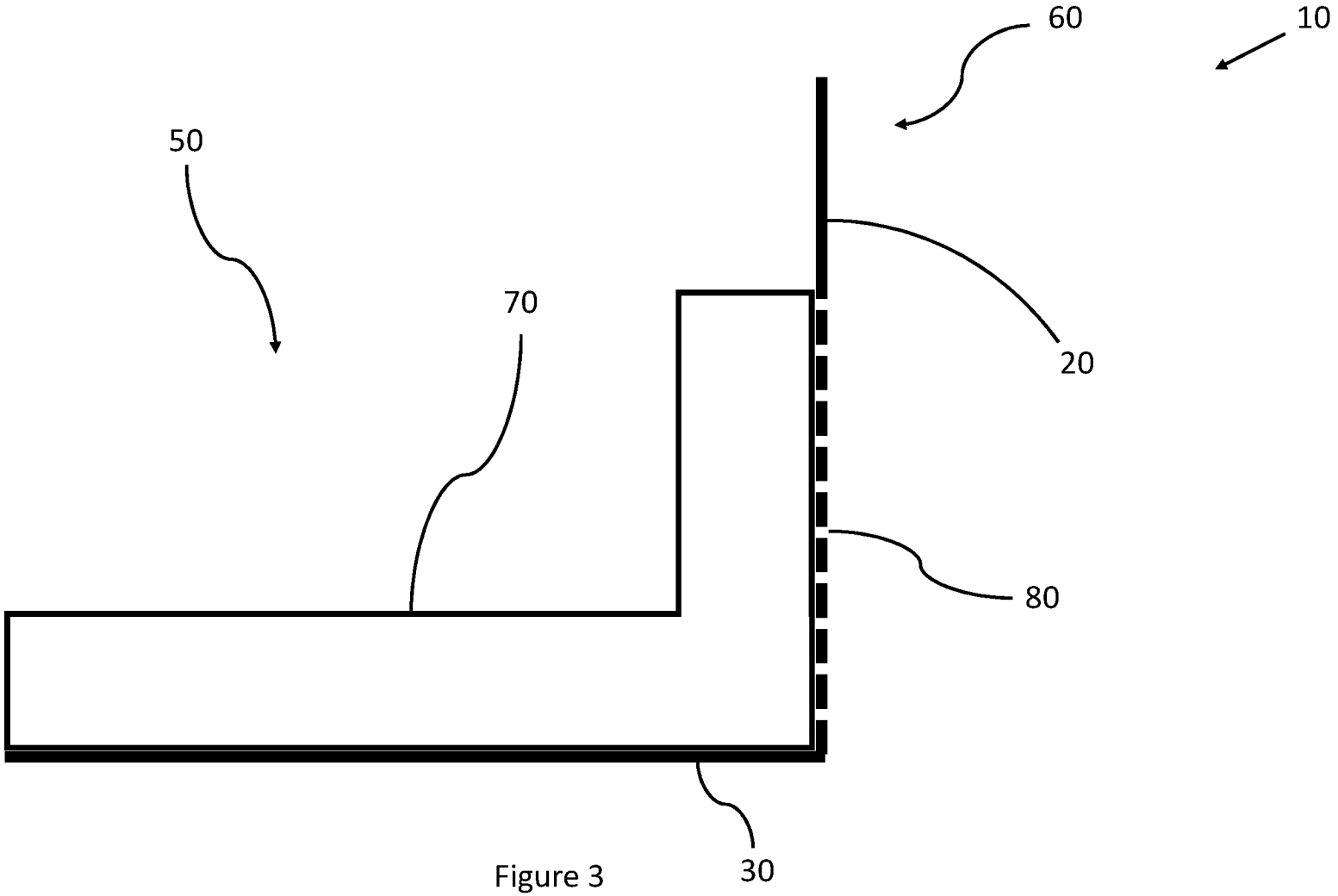
FIG. 3 is a schematic cross sectional view of components of the toilet according to the present invention.

A second feature of bag 10 is a pressure sensitive adhesive 90, which is attached to the side walls 20 on the exterior 60 of bag 10, as shown in FIG. 2. The pressure sensitive adhesive goes completely around the circumference of the bag 10 on the exterior surface 60. The pressure sensitive adhesive 90 can be similar to materials commonly found in commercial tapes, such as acrylic or rubber adhesives which are designed to adhere to a surface when pressure is applied. FIG. 2 also shows the location of a third feature of bag 10, which are perforations 80 in the side walls 20 of bag 10 directly adjacent to filter 70. The perforations 80 are shown schematically in more detail in FIG. 3. FIG. 3 shows a close-up cross section of the bag 10, where side wall 20 is joined to bottom side 30 to form a corner. Perforations 80 are in the form of holes or slots that extend completely through the side walls 20 from the interior 50 of bag 10 to the exterior 60 of bag 10.

Figure 4:
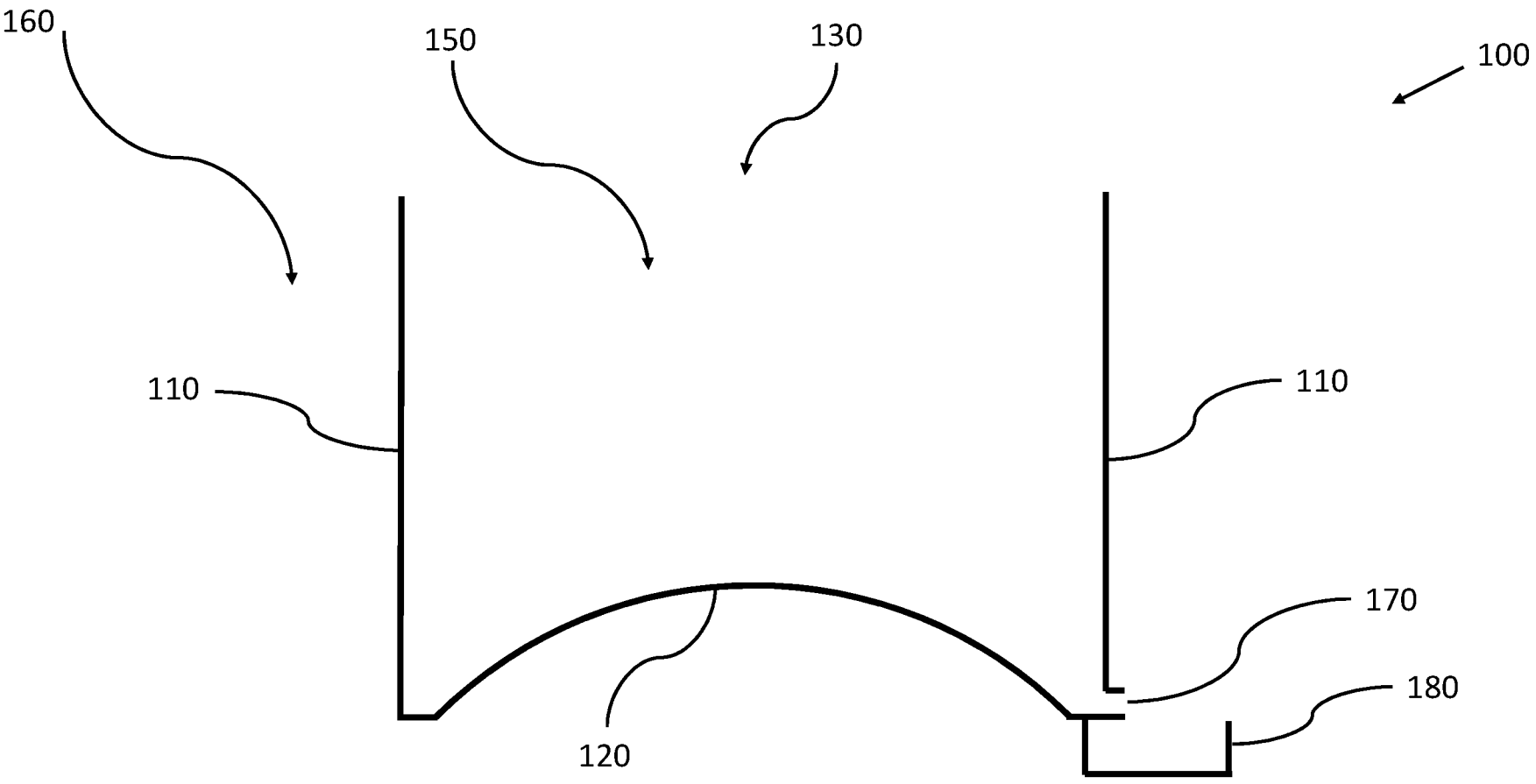
FIG. 4 is a schematic cross sectional view of components of the toilet according to the present invention.

FIG. 4 schematically shows a reusable compactor bag receptacle 100 as one of the main components of the toilet. The receptacle 100 includes closed side walls 110, a closed bottom side 120 and an open top side 130. The side walls 110 and bottom side 120 are joined at the edges to form a tank with an open top, a continuous enclosed interior 150 and an exterior 160. The dimensions of bottom side 120 of the receptacle 100 is similar to bottom side 30 of bag of approximately 1.5-2.0 feet in diameter if it is round or about 1.5×1.5 feet if square. Bottom side 120 of the receptacle 100 is a sloped surface with the center higher than the edges, as shown in FIG. 4. The slope from center to the edges ensures that a liquid runs over the surface of bottom side 120 from its center toward the edges. The slope in bottom side 120 is exaggerated in FIG. 4 for illustration. In practice the slope could be as little as that found in common drain pipes in a house, which is about ¼ inch drop in elevation for every linear foot of drain pipe. Therefore, if receptacle 100 was circular with a radius of one foot, the center of bottom side 120 could be as little as ¼ inch higher than its edges for water to flow from its center to its edges. The receptacle 100 has a drain 170 so that liquids accumulating on the enclosed interior 150 of the receptacle 100 can exit to the exterior 160 of the receptacle 100. Liquids exiting the receptacle 100 will accumulate in container 180 for storage and subsequent disposal.

The receptacle 100 can be plastic, metal, a combination of plastic and metal or another material. The receptacle 100 can be various shapes such as cylindrical, rectangular or other shape, but typically matches closely the shape and size of the bag 10 so that bag 10 fits inside the receptacle 100. Container 180 can also be comprised of plastic, metal, a combination of plastic and metal or another material and can be various shapes such as cylindrical, rectangular or other shape. Container 180 is large enough to hold the liquid that accumulates in the receptacle 100 during use, but is convenient in size and weight for the user to easily empty the container 180 periodically.

Figure 5:
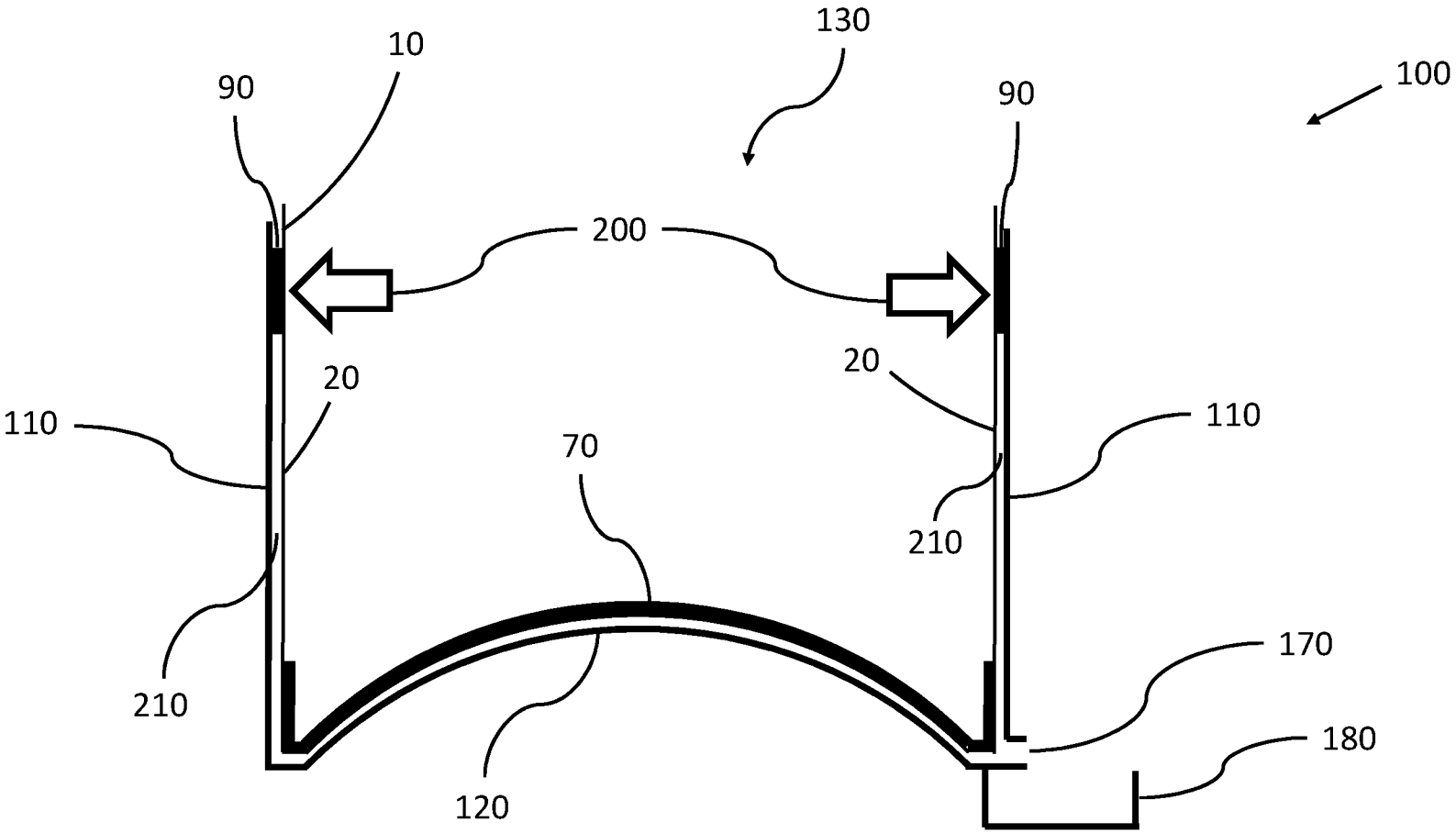
FIG. 5 is a schematic cross sectional view of components of the toilet according to the present invention.

FIGS. 5-12 show the operation of an embodiment of the toilet 10 of FIGS. 1-4. The first step is to place a first bag 10 in the receptacle 100 with the open top side 40 of bag 10 facing upwards toward the open top side 130 of receptacle 100, as shown in FIG. 5. The bottom side 30 of the first bag 10 rests on the bottom side 120 on the interior 150 of the receptacle 100. Because bag 10 is comprised of a thin plastic material it is flexible and therefore conforms to the sloped shape of the bottom side 120. After insertion of the first bag 10 into the receptacle 100, the user manually presses on the side walls 20 on the interior 50 of bag 10, directly adjacent to where the pressure sensitive adhesive 90 is attached to the exterior 60 of bag 10 and against the interior 150 of side walls 110 of the receptacle 100. By applying force 200 to bag 10 against the side walls 110 of the receptacle 100, the pressure sensitive adhesive 90 on the exterior 60 of bag 10 is forced to adhere to the interior 150 of side walls 110 of the receptacle 100, forming a seal between the bag 10 and the receptacle 100. The user applies pressure all around the interior 50 of bag 10 against the receptacle 100 adjacent to where the pressure sensitive adhesive 90 is attached to the outside of bag 10. This force 200 causes bag 10 to adhere to the receptacle 100 forming a seal which creates sealed space 210 between the first bag 10 and the side walls 110 of the receptacle 100.

Figure 6:
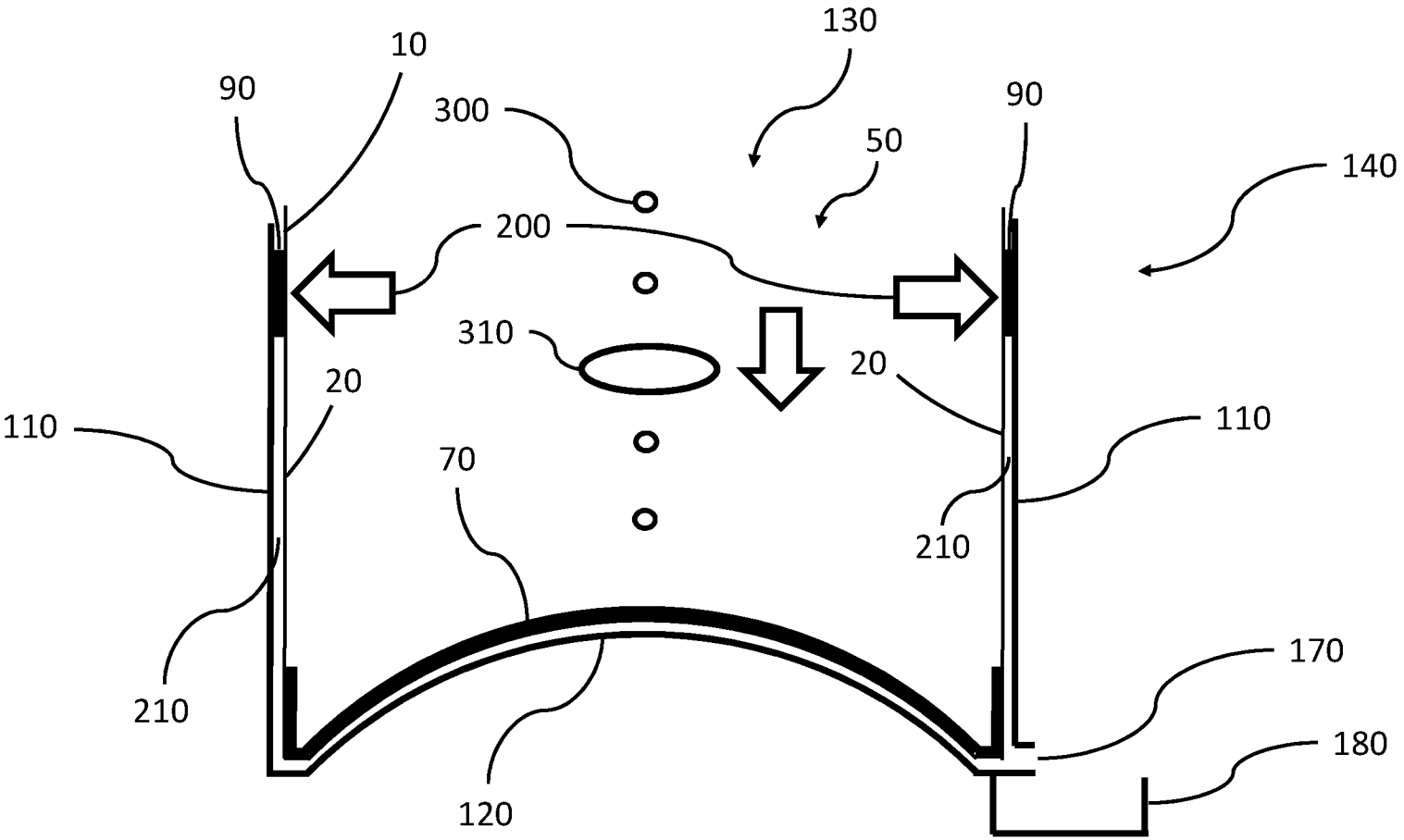
FIG. 6 is a schematic cross sectional view of components of the toilet according to the present invention.
Figure 7:
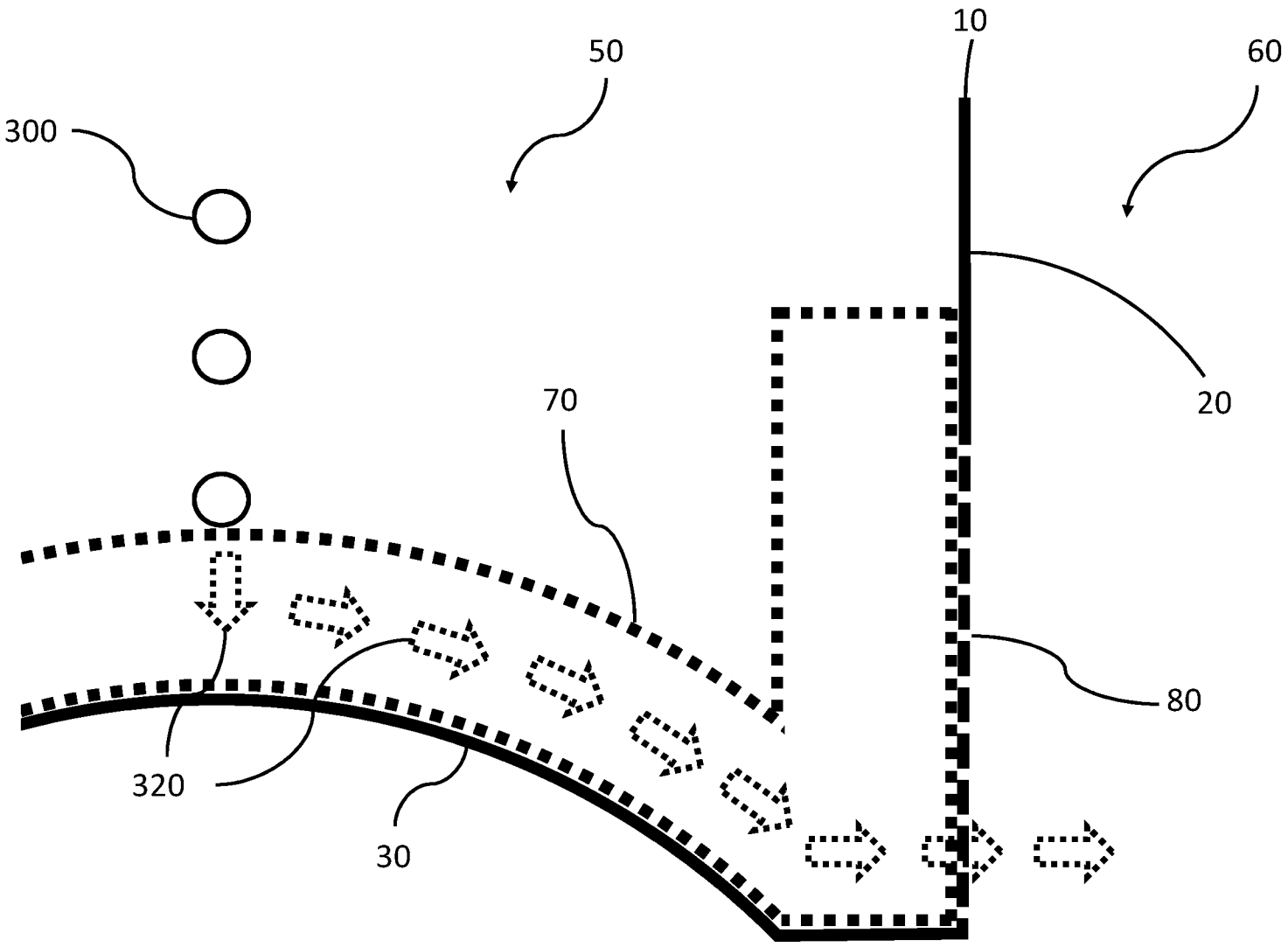
FIG. 7 is a schematic cross sectional view of components of the toilet according to the present invention.

FIG. 6 shows that once the first bag 10 has been inserted and adhesively attached to the receptacle 100, the user can then use the receptacle 100 as a toilet. The user urinates, defecates or both directly into the interior 50 of the first bag 10. The waste compactor 100 is designed so that the urine 300 and feces 310 drop into the center of the interior surface of the bottom side 30 of the first bag 10. FIG. 7 shows a close-up of the first bag 10 in the receptacle 100, as urine 300 falls into the center of the first bag 10. The urine 300 first contacts the filter 70, which is attached to the bottom side 30 of the first bag 10 on the interior 50. Because filter 70 is porous when urine 300 impinges the filter 70, the urine 300 is quickly absorbed completely into filter 70. As the urine travels through the filter 70, the urine is filtered and deodorized into a processed liquid 320 by the physical structure of the filter 70 and/or the chemicals within filter 70. The flow of the processed liquid in filter 70 is shown in FIG. 7. Directly after urine 300 contacts the filter 70, the flow of the liquid is downward into filter 70 towards the bottom side 30 of the first bag 10, due to the force of gravity acting on the liquid. The liquid flows downward into filter 70 and contacts the bottom side 30 of the first bag 10, where the liquid can no longer continue downward, because the bottom side 30 of the first bag 10 is a closed surface. The flow of liquid is therefore forced to change directions due to bottom side 30. The liquid then flows in filter 70 parallel to bottom side 30 of the first bag 10. The force of gravity acting on the liquid forces the liquid to follow the sloped shape of the bottom side 30 of the first bag 10 until it reaches the side walls 20 of the first bag 10. Once the processed liquid from the filter reaches side walls 20 of the first bag 10 it can then exit the first bag 10 through perforations 80 in side walls 20.

The combination of bag 10 and filter 70 on the bottom side 30 ensures the liquid will flow an adequate distances along the filter 70. For example, the liquid will flow a distance of 1-foot from the center of a 2-foot diameter round filter to the edge, rather than just through the thickness of the filter 70 which can be as low as about ¼ inch. In general, the longer the distance that liquid flows through a filter, the more effective the filtering of the liquid will occur. Bag 10 will process the liquid because of the liquid must travel through filter 70 before reaching perforations 80 of side wall 20 of bag 10. If there were perforations 80 in the bottom side 30 of bag 10 directly below where the urine 300 impinged on filter 70, the distance the liquid would travel through filter 70 would be very short due the thickness of the filter.

If the user is urinating only in the first bag 10, the user can urinate many times into bag 10 without odors from the bag 10 becoming too great, because of the unique design of bag 10. As the liquid flows through the filter 70 of bag 10, the impurities and particles will be filtered out by the filter 70.

Bacteria and microbes can be killed by chemicals included in filter 70. So that by the time liquid reaches the perforations 80 in side walls 20 of bag 10, the liquid has been processed by the filter 70. Odors from the urine can be minimized by deodorant chemicals in filter 70. Odors are also minimized by the fact that all of the liquid exits the bag 10 into the receptacle 100 and then out drain 170 into container 180 as a processed liquid. The amount of processing of the liquid by filter 70 in bag 10 depends on the filter design in particular the filter materials, the filter density, the length the urine travels through it, etc. Filter 70 could include a variety of materials or combinations of materials, but the preferred material would be paper because of its low cost. Filters can also be produced with a range of different types of fibers. For example, the filter paper used in fuel filters is a mixture of hardwood and soft wood fibers. Some coffee filters are made from cloth based or cotton fibers rather than from cellulose fibers derived from trees. For oil filters, synthetic fibers such as glass and polyester are combined with the wood based cellulose fibers to increase the filter efficiency and durability. Since filter 70 is filtering particles out of liquid that runs along the length of filter 70 rather than through its thickness, the effectiveness of filter 70 at removing particles for a given distance the liquid travels through it does not need to be as great as a filter which filters through its thickness such as a coffee filter. The filter could also be the type that would purify the waste liquid into potable liquid.

Figure 8:
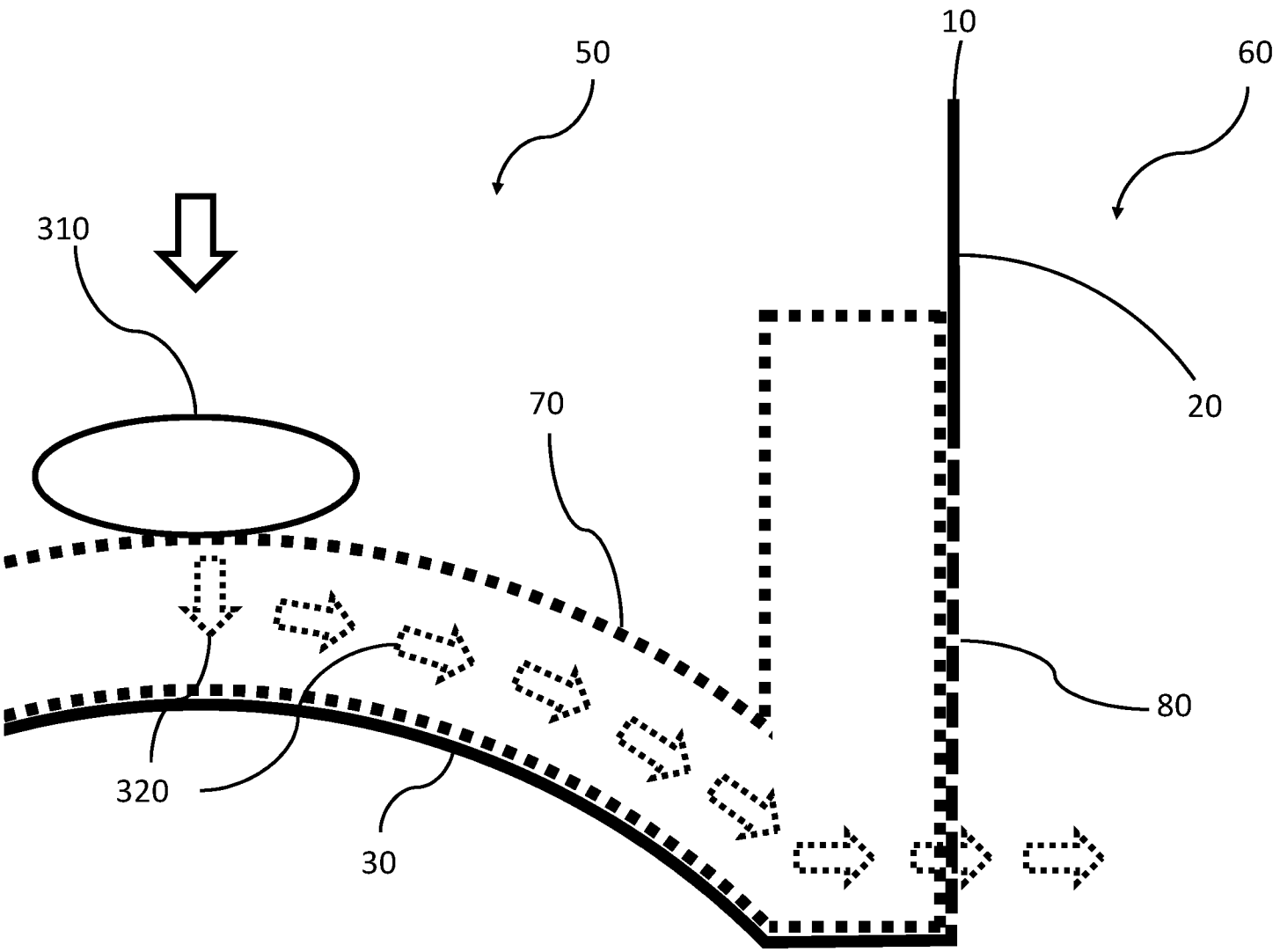
FIG. 8 is a schematic cross sectional view of components of the toilet according to the present invention.

FIG. 8 shows feces 310 which has landed on filter 70 in the center of the first bag 10. Whereas the urine 300 will be immediately absorbed completely in filter 70 when it impinges on filter 70, the liquid held within the solid feces 310 will be drawn out more slowly into filter 70. One type of force that will act to draw liquid out of the feces 310 and into filter 70 is gravity acting on the liquid in the feces 310. The second force that will draw liquid out of the feces 310 is the capillary action of the filter 70 in a similar way a paper towel would absorb liquid from a wet countertop when in contact with that liquid. FIG. 8 shows that once liquid is drawn out of the feces 310, the liquid will flow downward into filter 70 below feces 310 and then across the filter 70 in a similar pathway to the flow of liquid after the user urinated into the bag 10. The liquid flows downward into the filter 70 and then parallel to bottom side 30 of the first bag 10 until it reaches the side walls 20 and then exits the first bag 10 through perforations 80 in side walls 20.

Feces 310 can have different densities and hardness's. Feces 310 that are soft and deformable will tend to stay in the center of the bottom side 30 of bag 10 where the feces 310 landed. However, the larger the slope in the bottom wall 120 of the receptacle 100, the greater the tendency for harder, rounded feces to roll toward the edges of bag 10 after landing in the center of bag 10. It is undesirable for feces 310 to roll to the edges of side 30 of bag 10 because that will shorten the distance that liquid from feces 310 will travel in filter 70 before exiting bag 10, which will reduce the amount of processing of this liquid. Therefore, the magnitude of the slope of bottom side 120 of the receptacle 100 should be established so that liquid will readily flow toward the edges, but all feces will still stay centered in bag 10. Rather than coming to a point at its center, bottom side 120 of the receptacle 100 could have flat plateau at the center which is elevated relative to the edge of bottom side 120 and then a slope from this plateau to the sides 110 of the receptacle 100. This plateau may aid in keeping feces centered in bag 10. Unlike with urination, the user can only defecate once in bag 10 before the next step in the waste containment process needs to be undertaken. This is because feces 310 is not immediately and completely absorbed into filter 70, where the chemicals in filter 70 can then act to neutralize the odors from feces 310. Because the feces 310 sits on top of filter 70 in bag 10 and bag 10 is open, there will be foul smells that emanate from the feces 310 if left unsealed.

Figure 9:
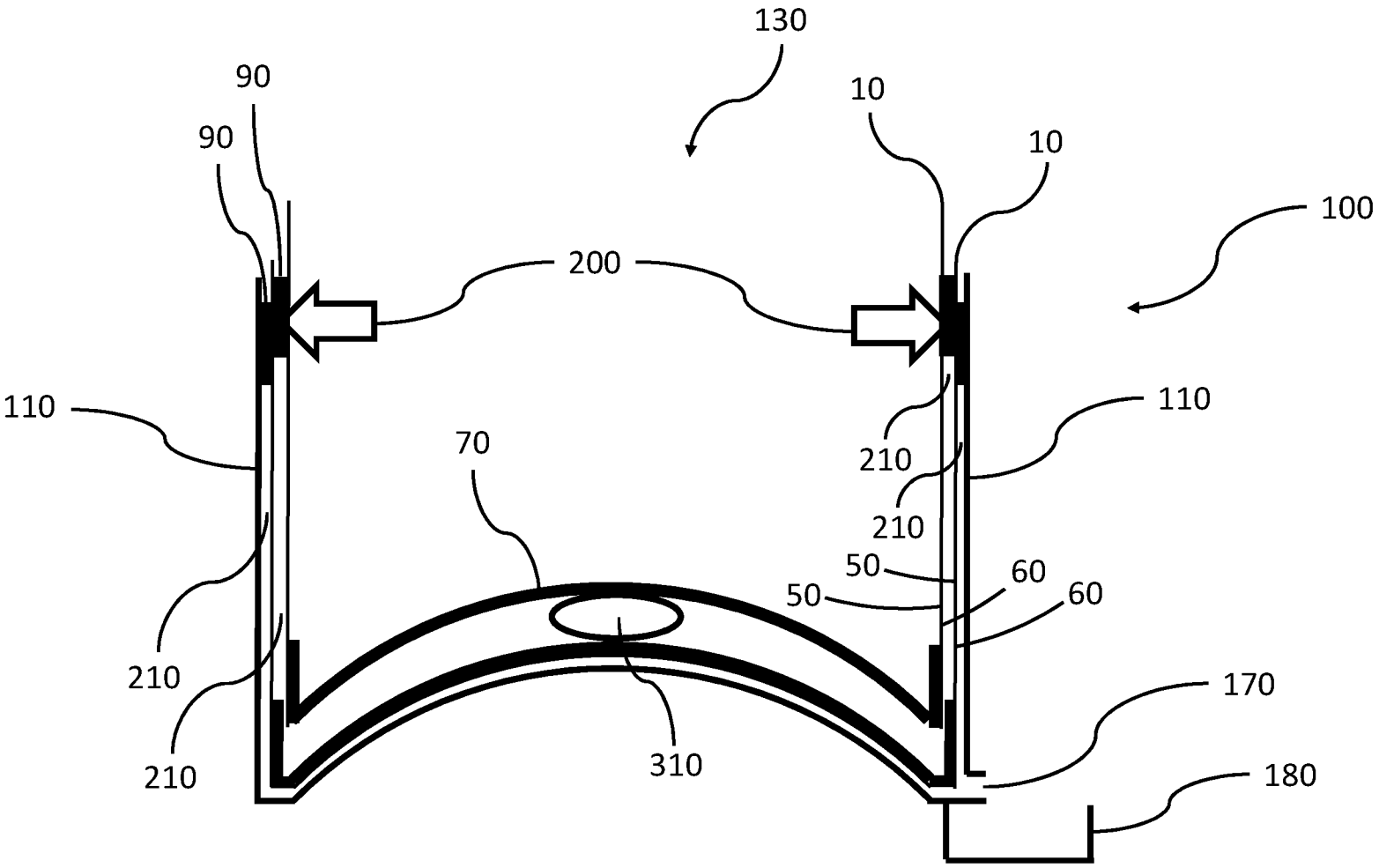
FIG. 9 is a schematic cross sectional view of components of the toilet according to the present invention.
Figure 10:
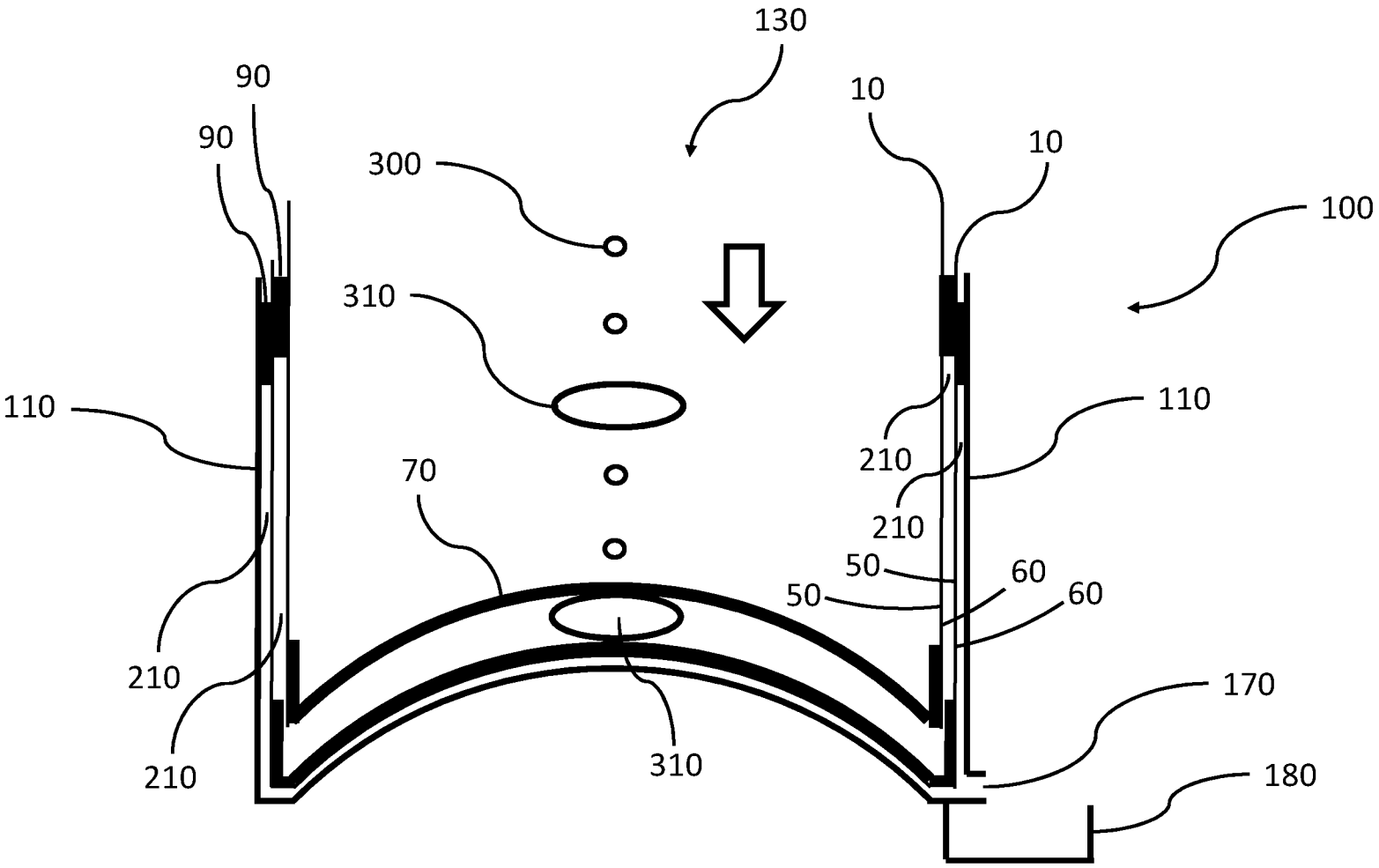
FIG. 10 is a schematic cross sectional view of components of the toilet according to the present invention.

Once the user defecates into the first bag 10, the user then inserts a second bag 10 inside the interior 50 of the first bag 10, as shown in FIG. 9. The second bag 10 drops toward the bottom of the receptacle 100, so that the bottom wall 30 of the second bag 10 comes to rest on the feces 310, which in turn is resting on filter 70 within the first bag 10. After insertion of the second bag 10 into the first bag 10 in the receptacle 100, the user performs a similar process used to seal the first bag 10 to the receptacle 100 in order to adhere the second bag 10 to the first bag 10. The user manually presses on the side walls 20 on the interior 50 of the second bag 10. The pressure is directly adjacent to where the pressure sensitive adhesive 90 is attached to the exterior 60 of the second bag 10, against the interior 50 of the side walls 20 of the first bag 10 to create a force 200, as shown in FIG. 9. By applying force 200 to the second bag 10 against the first bag 10, the pressure sensitive adhesive 90 on the exterior 60 of the second bag 10 forces the walls 20 of the second bag 10 to adhere to the walls 20 of the first bag 10 forming a seal between the bags 10. The user applies pressure all around the interior 50 of the second bag 10 against the first bag 10 forming a seal which creates sealed space 210 between the side walls 20 of the second bag 10 and the side walls 20 of the first bag 10. Once the second bag 10 is inserted and sealed against the first bag 10, the odors from the feces 310 sitting on top of filter 70 in the first bag 10 can no longer reach the user and hence the receptacle 100 can remain idle until the next use without producing offensive odors. The receptacle 100 is also ready for the user to urinate or defecate or both again. FIG. 10 shows the user urinating and defecating into the interior 50 of the second bag 10.

Figure 11:
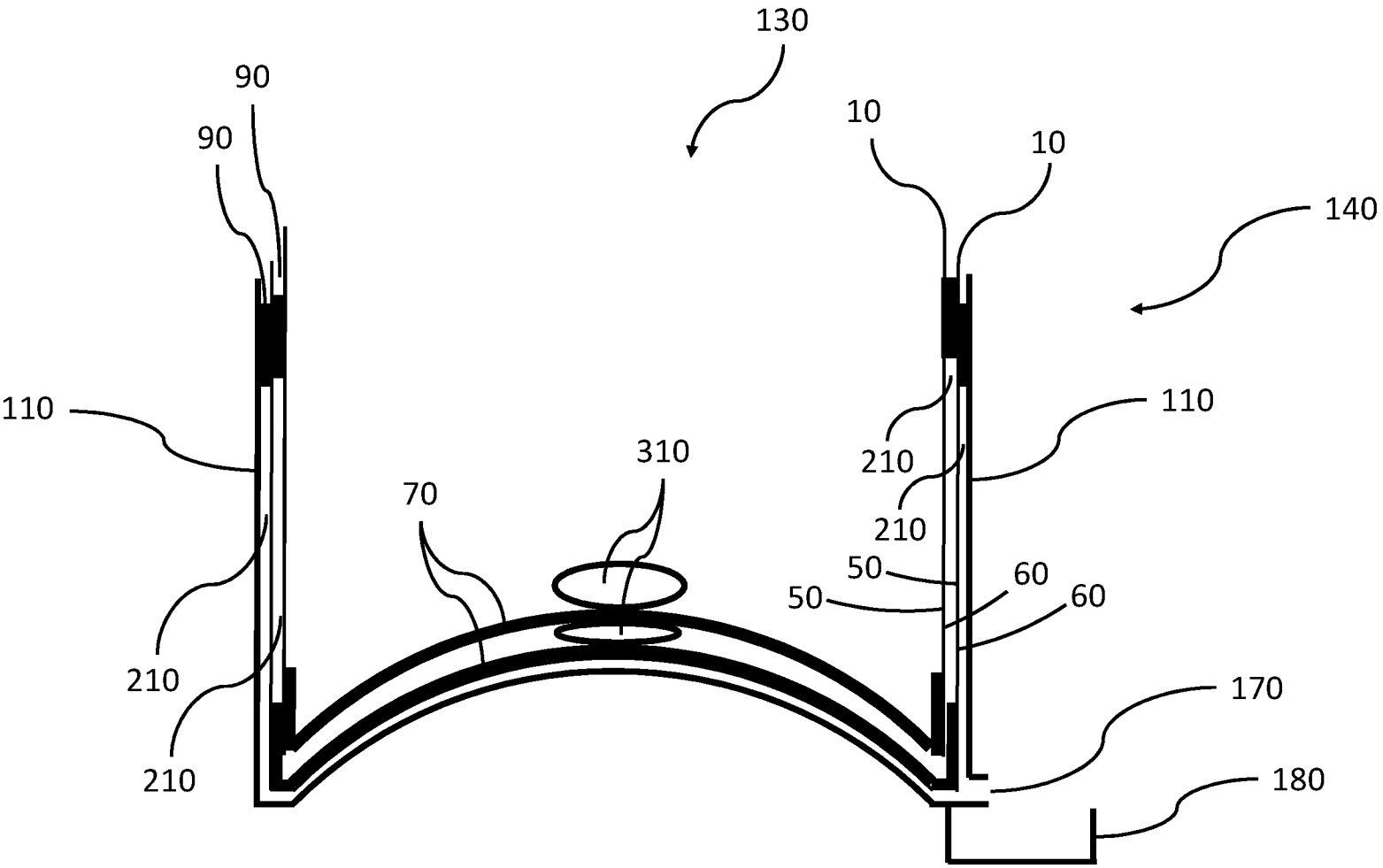
FIG. 11 is a schematic cross sectional view of components of the toilet according to the present invention

FIG. 11 shows the two bag's 10 after the user defecates into the second bag 10. The weight of the feces 310 in the second bag 10 pressing down on the feces 310 in the first bag 10 causes feces 310 in the first bag 10 to become slightly flattened. The amount of compaction or flattening of the feces 310 in the first bag 10 will be slight with only one additional bag 10 with feces 310 above providing downward pressure. However, as more and more bags 10 with more feces 310 are subsequently added to the receptacle 100, the weight of these feces 310 will become greater. The amount of flattening of the feces 310 in the first bag 10 will increase. In this manner the weight of subsequent feces will act as a natural compaction force on feces deposited earlier into the receptacle 100. The downward pressure on the feces will cause liquid to be squeezed out of the feces 310 at a faster rate and to a greater extent than if no pressure was applied.

Figure 12:
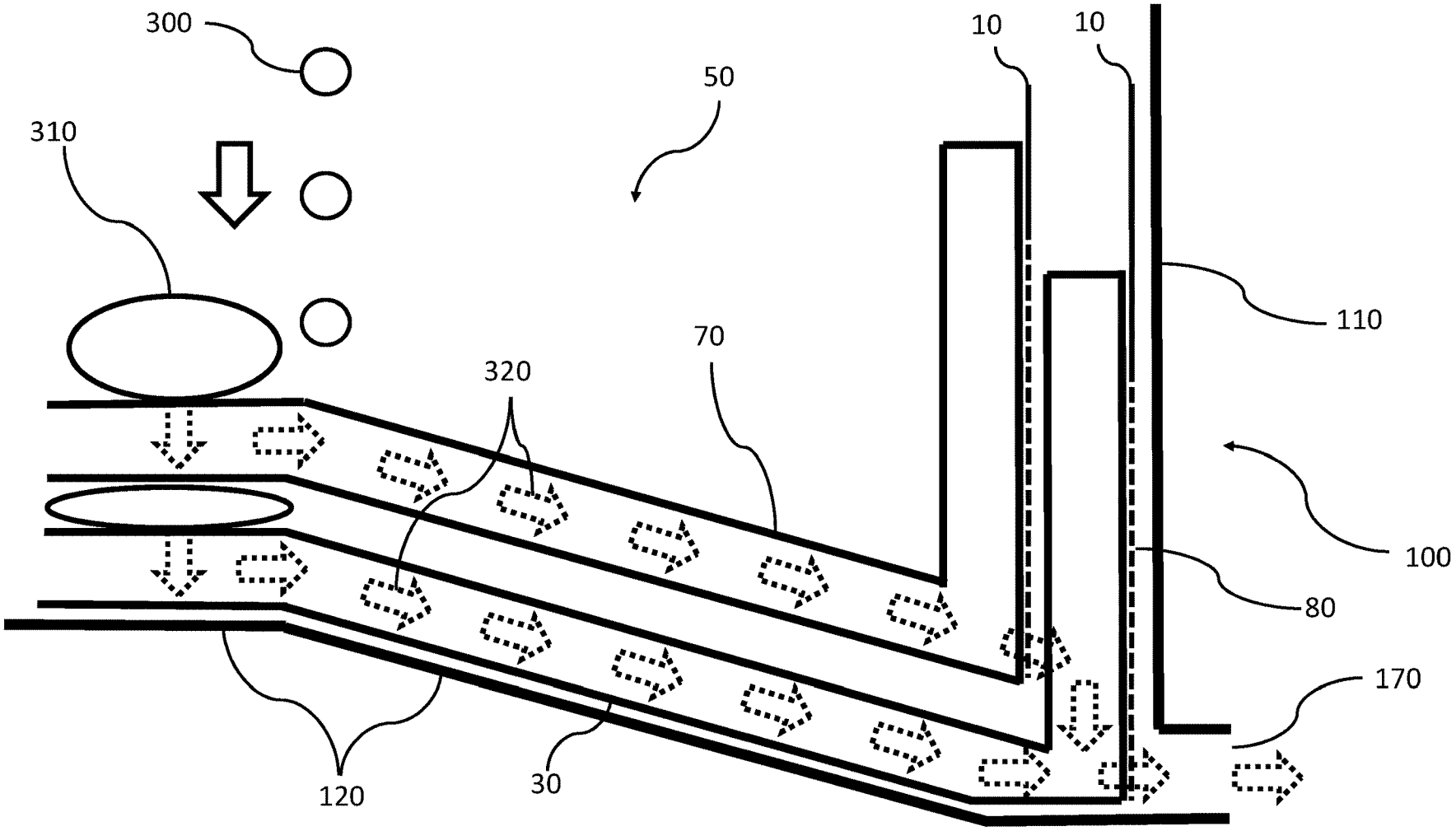
FIG. 12 is a schematic cross sectional view of components of the toilet according to the present invention.

FIG. 12 shows the pathway of liquid removed from the urine 300 and feces 310 using filter 70 in the second bag 10 is similar to that in the first bag 10. In this case since the second bag 10 is held within the first bag 10, the liquid exiting the second bag 10 through the perforations 80 in the side wall 20 of the second bag 10 will first flow into the filter 70 on the side walls 20 of the first bag 10 before exiting through the perforations 80 in the side walls 20 of this first bag 10. The process of inserting and sealing bags into the receptacle 100 followed by defecation and urination into these bags can be repeated many times until the receptacle 100 fills with the bags 10 containing compacted feces 310. Once the receptacle 100 is filled with the bags 10, the receptacle 100 needs to be emptied before the toilet can be used again. To empty the accumulated bags 10 out of the toilet, the seal between the first bag 10 and the receptacle 100 needs to be broken. Then, the collection of bags 10 that are adhered together by their side walls can be removed from the receptacle 100 and disposed of in a trash receptacle. Alternatively, the receptacle 100 can be removable and taken out of the toilet to a trash receptacle and inverted to empty the bags 10. The container 180 holding the liquid from the waste products requires emptying by the user when it fills. The user can remove the container 180 and then pour the liquid on the ground, if the filter is designed to properly process the liquid to an acceptable level for such disposal. Alternatively, the toilet can include an evaporator to evaporate the process liquid, so that the liquid in the container 180 does not need to be emptied. The evaporator could be powered with a small amount of electrical power or simply be a large pan that allows water to evaporate without added electrical power. It can be seen that the described embodiment is completely manual, simple to use and requires no electrical power. However, the amount of compaction and flattening of the feces as well as rate and magnitude of the liquid removal from the feces is not great because the pressure on the feces is low.

Figure 13:
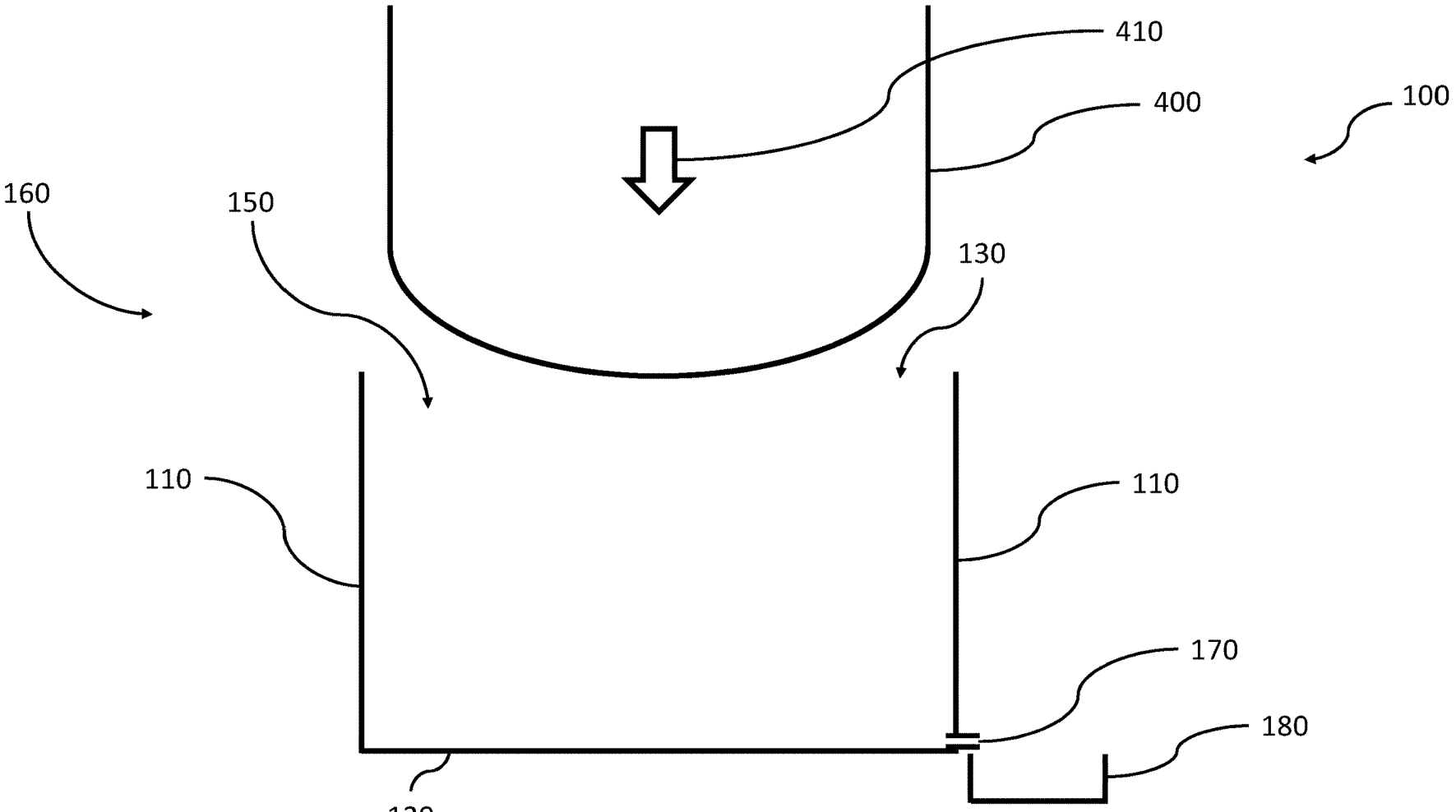
FIG. 13 is a schematic cross sectional view of components of the toilet according to the present invention.

FIG. 13 shows a schematic of a method to provide external pressure to be exerted on the feces contained in bags 10. The receptacle 100 in this case is the same as that shown in FIG. 4 with the addition of a ram 400 that can be used to exert a force 410 downward into the receptacle 100. In FIG. 13, the bottom side of the receptacle 100 is not shown as sloped as it is in FIG. 4 for simplicity. Ram 400 can be made of various materials and be in different forms including a metal or hard plastic piston, a metal or plastic bellows or a thick-walled plastic or rubber balloon that is inflated. What is required of the ram is that the ram have the structural strength to impart the pressure to flatten the bags 10 containing the feces 310.

Figure 14:
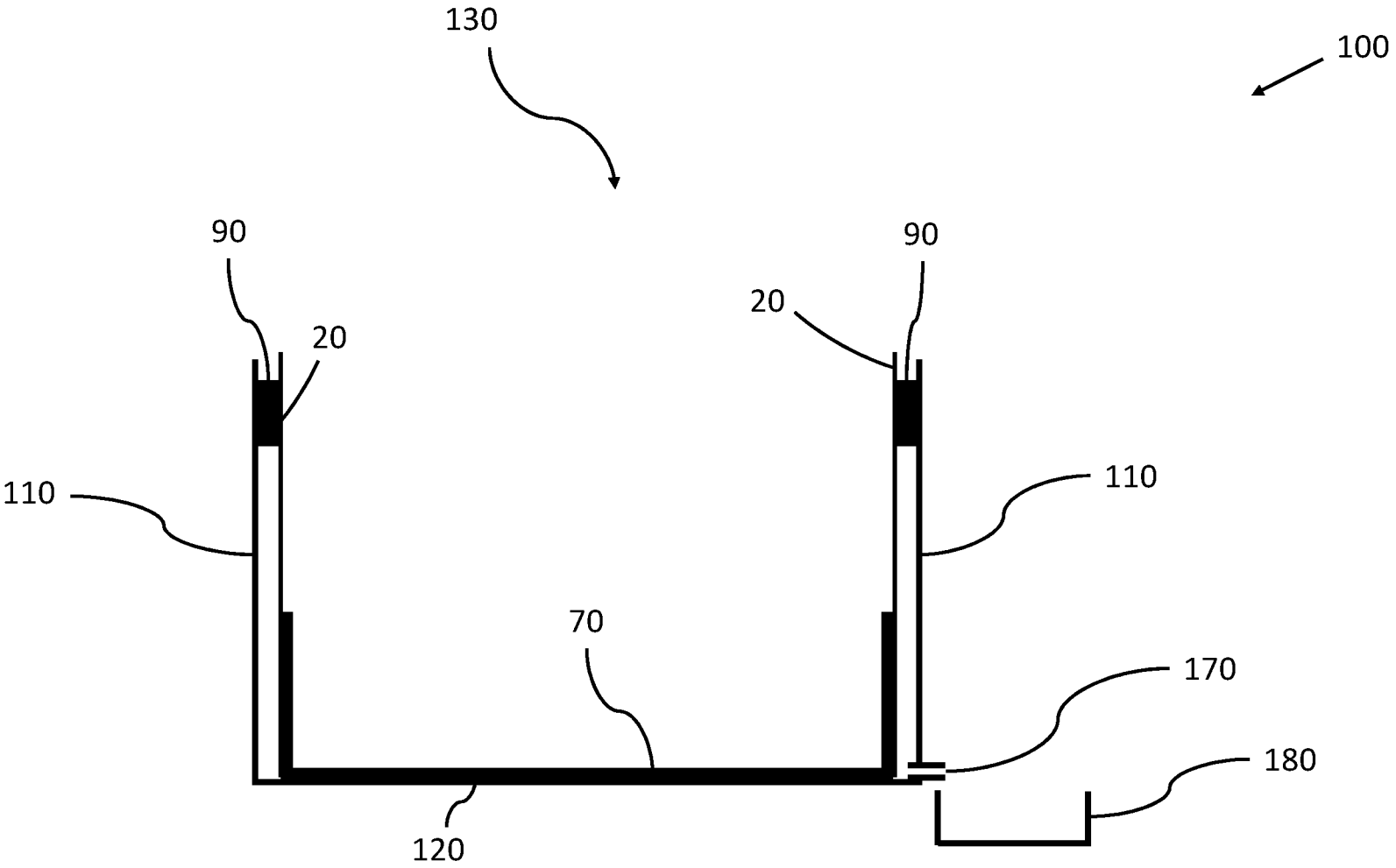
FIG. 14 is a schematic cross sectional view of components of the toilet according to the present invention.
Figure 15:
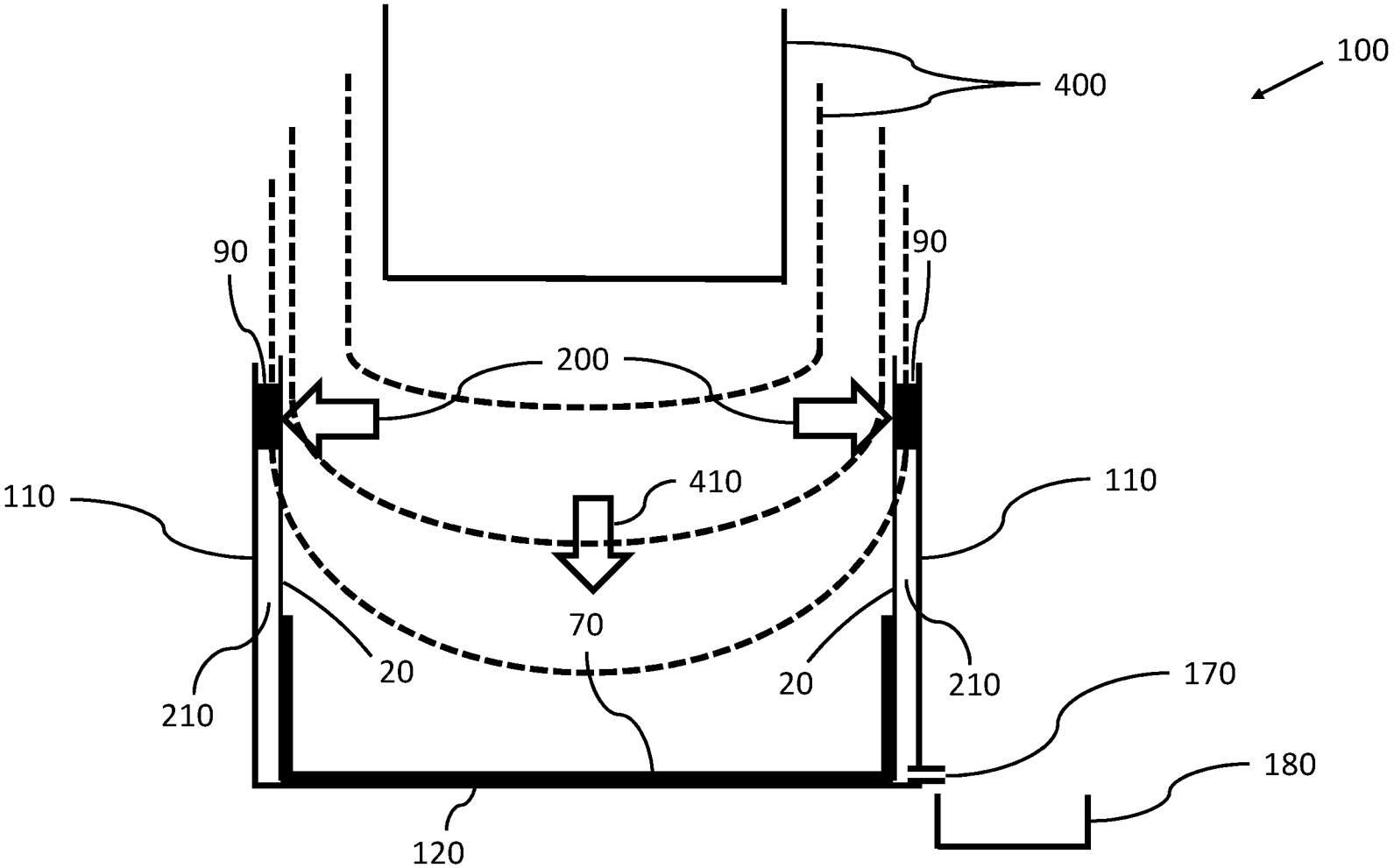
FIG. 15 is a schematic cross sectional view of components of the toilet according to the present invention.
Figure 16:
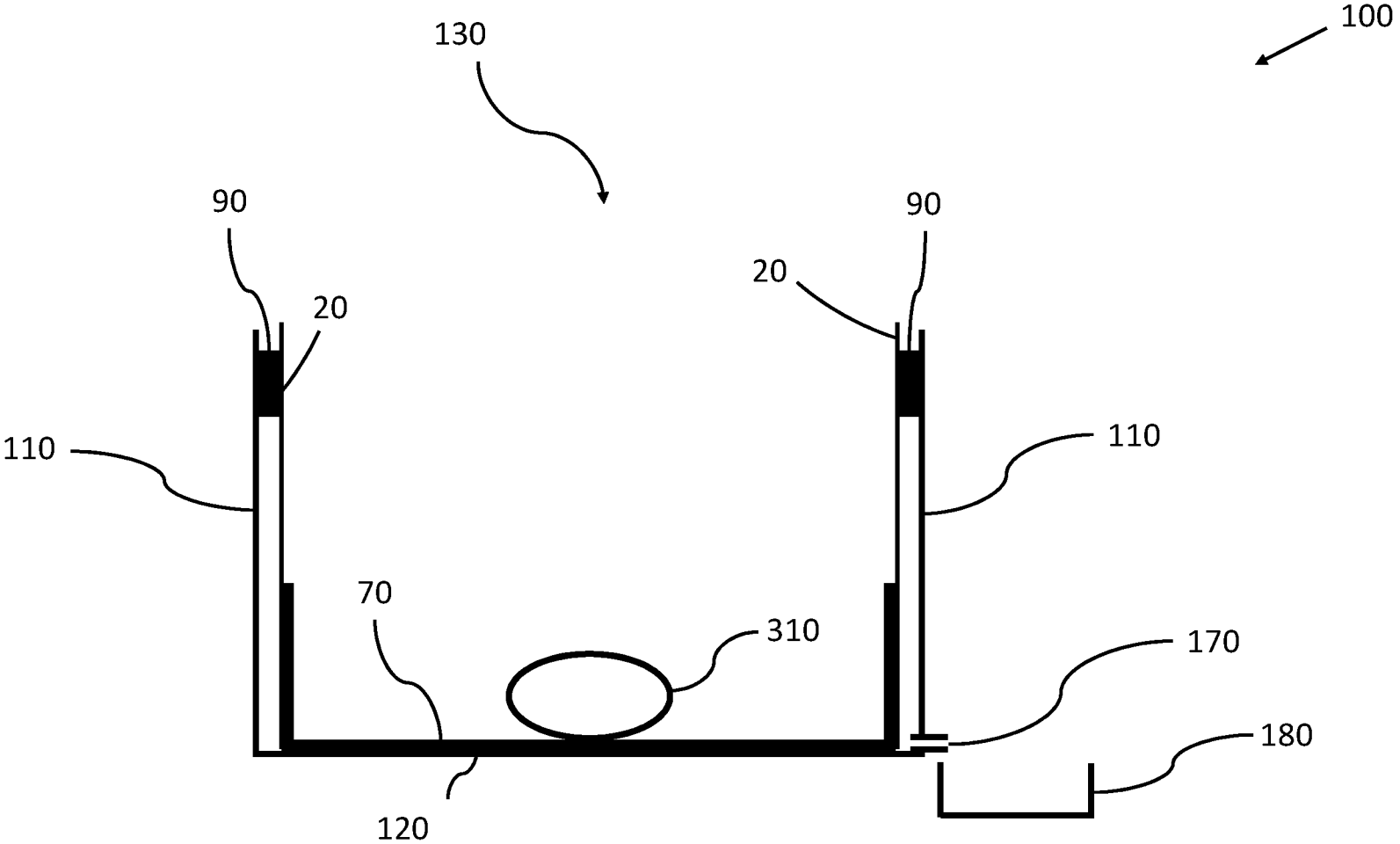
FIG. 16 is a schematic cross sectional view of components of the toilet according to the present invention.
Figure 17:
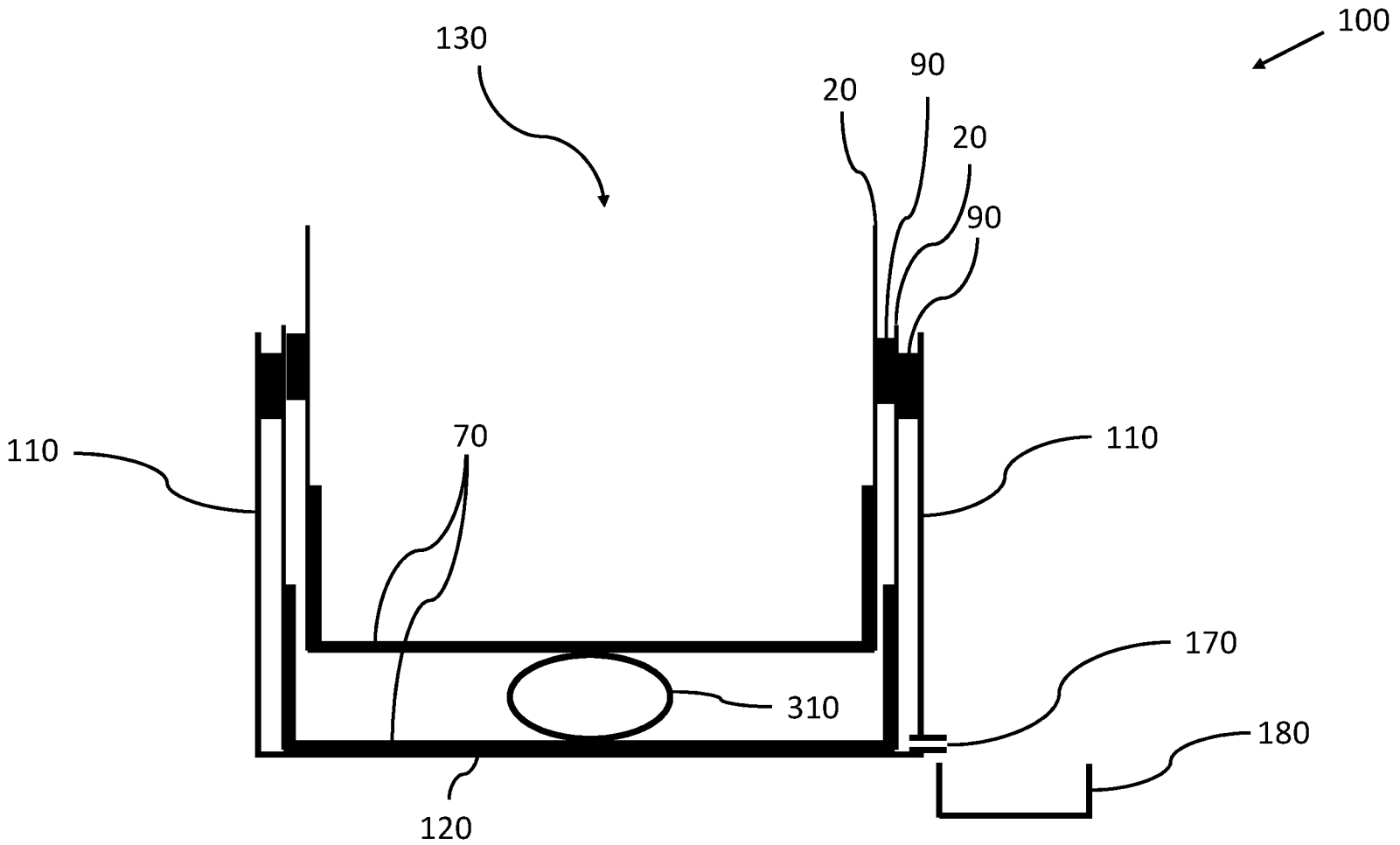
FIG. 17 is a schematic cross sectional view of components of the toilet according to the present invention.

FIGS. 14-23 show operation of the toilet where the ram 160 is an expandable rubber balloon. FIG. 14 shows the user placing a first bag 10 in the receptacle 100, so that bag 10 rests on the interior bottom of the receptacle 100. The user does not need to apply manual pressure to the first bag 10 to seal it to the walls 110 of the receptacle 100. Once the first bag 10 is inserted into the receptacle 100, the user presses a button on the receptacle 100, which cause ram 400 to be inflated with air. As ram 400 is inflated, the ram expands downward into the interior of the first bag 10 toward the bottom side 120 of the receptacle 100, as well as outward toward walls 110 of the receptacle 100, as shown in FIG. 15. The expansion of ram 400 outward toward side walls 110 of the receptacle 100 exerts a force 200 against the side walls 20 of the first bag 10. That force 200 forces the adhesive 90 on the exterior of the side walls 20 of the first bag 10 against the side walls 110 of the receptacle 100. The force 200 adheres the adhesive 90 to the walls 110 of receptacle 100 creating the sealed space 210. Once the first bag 10 has been adhered to the receptacle 100 by ram 400, the ram is then deflated. The user can then urinate and defecate into the first bag 10. FIG. 16 shows feces 310 resting on filter 70 of the first bag 10. FIG. 17 shows a second bag 10 inserted into the first bag 10. Once the second bag 10 is inserted into the first bag 10 and rests on feces 310, the user again presses a button on the receptacle 100. The ram 400 will be inflated with air and expand downward toward the bottom side 120 of the receptacle 100, as well as outward toward walls 110 of the receptacle 100, as was shown in FIG. 15.

Figure 18:
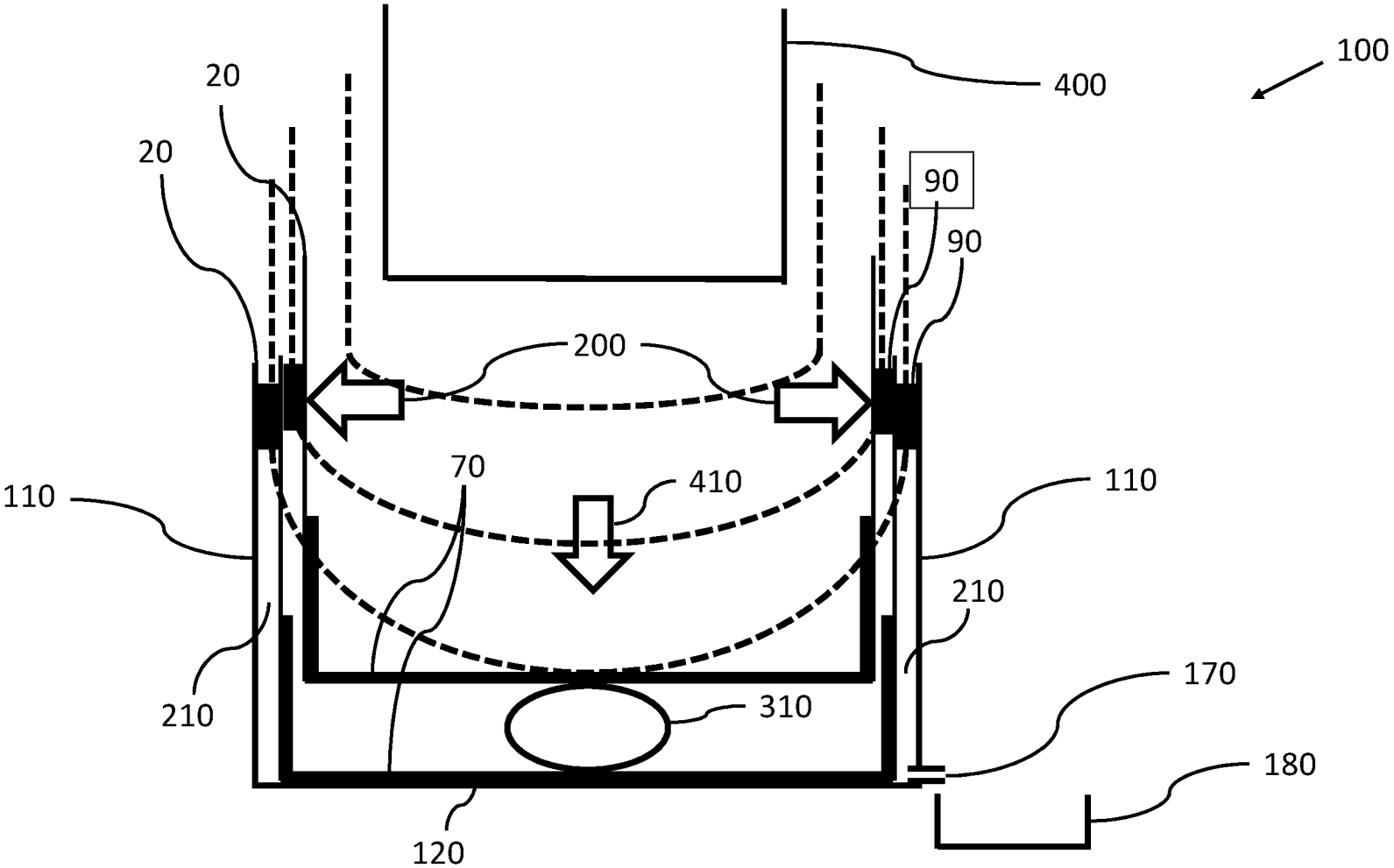
FIG. 18 is a schematic cross sectional view of components of the toilet according to the present invention.
Figure 19:
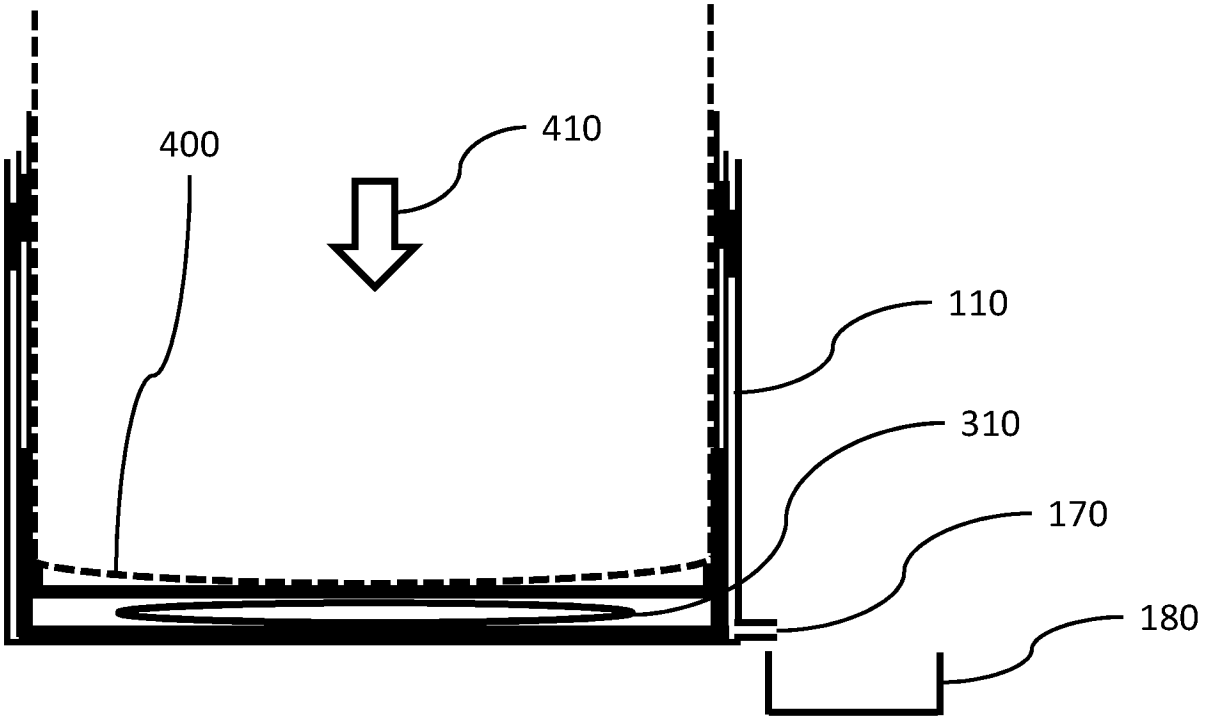
FIG. 19 is a schematic cross sectional view of components of the toilet according to the present invention.
Figure 20:
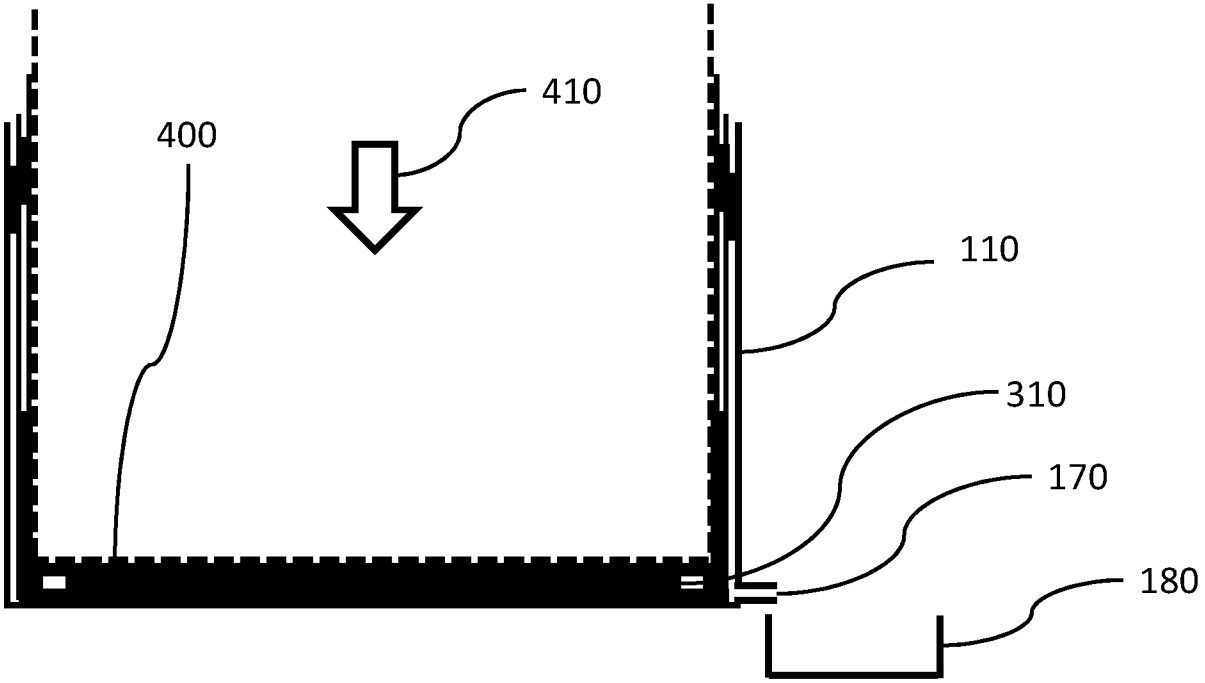
FIG. 20 is a schematic cross sectional view of components of the toilet according to the present invention.

FIG. 18 shows that the expansion of ram 400 outward toward side walls 110 of the receptacle 100 exerts a force 200 against the side walls 20 of the second bag 10, which the forces the adhesive 90 on the exterior of the side walls 20 of the second bag 10 into the side walls 20 of the first bag 10 to seal the bags 10 together. FIG. 18 also shows that as the ram 400 expands downward into the second bag 10 toward the bottom side 120 of receptacle 100, the ram 400 first contacts the filter 70 on the interior of the second bag 10 and creates a downward force 410 on the second bag 10 against the feces 310 resting on filter 70 of the first bag 10. FIGS. 19-20 show how the force 410 due to the inflation of ram 400 flattens the feces 310 in the first bag 10. During this compaction operation, the second bag 10 separates the ram 400 from the feces 310 in the first bag 10, so that the ram 400 does not become contaminated with feces 310. Feces 310 are contained between the first and second bag 10 during compaction and are sealed between the bags 10 by the adhesive 90 on the exterior of the second bag 10.

FIG. 18 shows that as the ram 400 is inflated before it contacts the second bag 10, the ram becomes convex in shape, as is typical when a rubber balloon is inflated. The convex shape of this rubber balloon version of ram 400 before contacting the second bag 10 is an advantage. The advantage is that ram 400 to applies pressure through the second bag 10 initially to the top and center of the feces 310 in the first bag 10. As ram 400 continues to move downward, the ram 400 will begin to flatten out due to the pressure exerted ultimately against the bottom side 120 of the receptacle 100. This change of shape of the ram 400 as pressure is applied through the second bag 10 against the feces 310 in the first bag 10 will force the feces 310 in the first bag 10 to spread out into a thin layer evenly across the filter 70 of the first bag 10, as shown in FIGS. 19-20. In the final compression stage, the feces 310 are flattened into a thin compressed layer with the ram 400 applying even pressure across the whole layer of feces 310.

Figure 21:
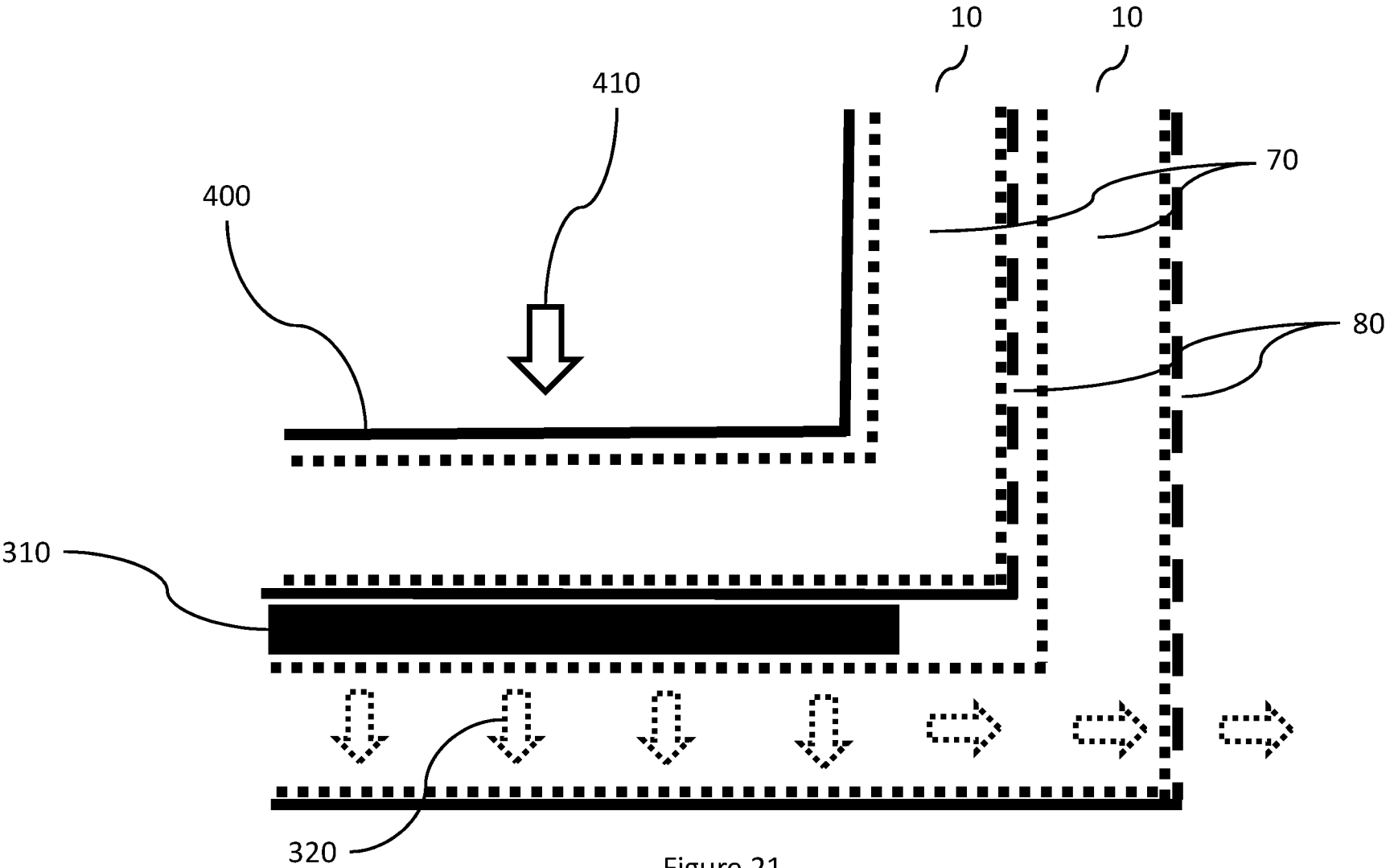
FIG. 21 is a schematic cross sectional view of components of the toilet according to the present invention.
Figure 22:
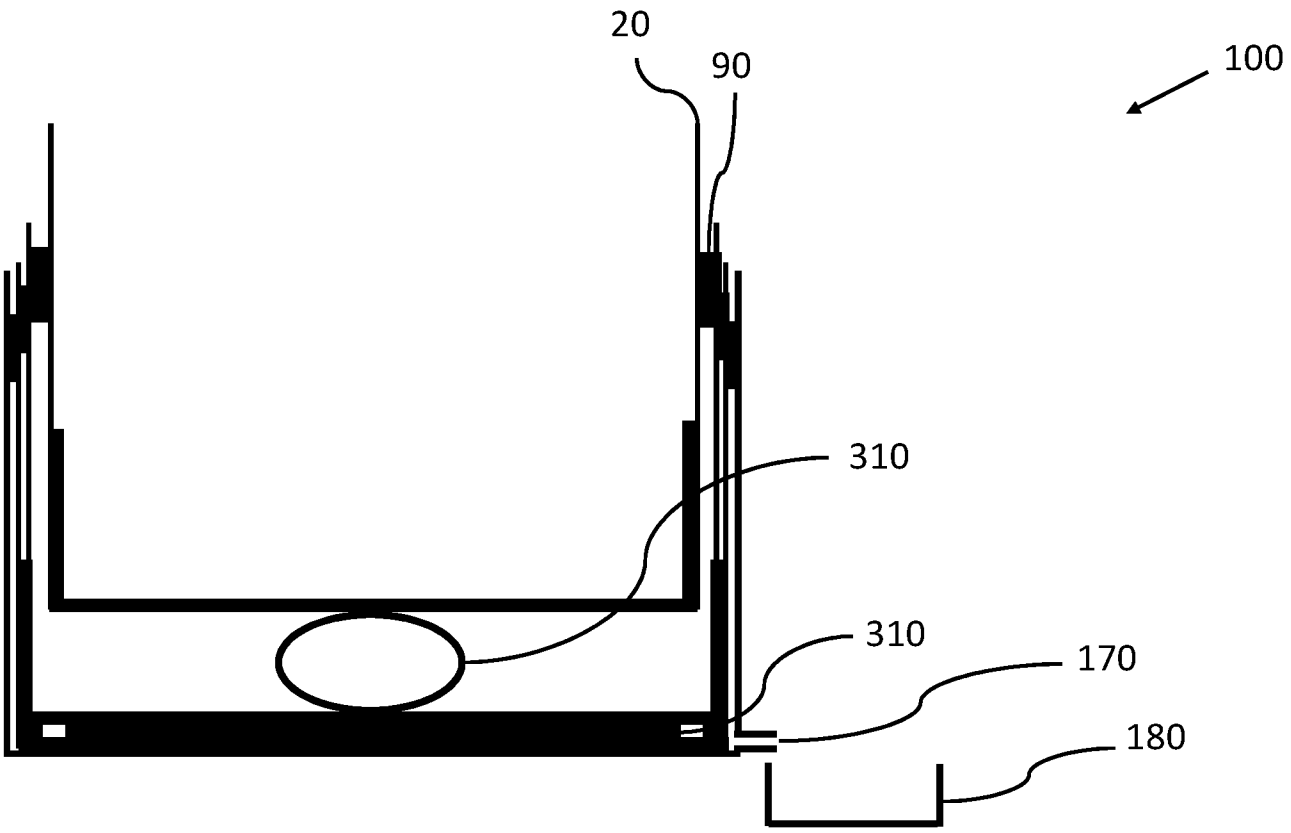
FIG. 22 is a schematic cross sectional view of components of the toilet according to the present invention.
Figure 23:
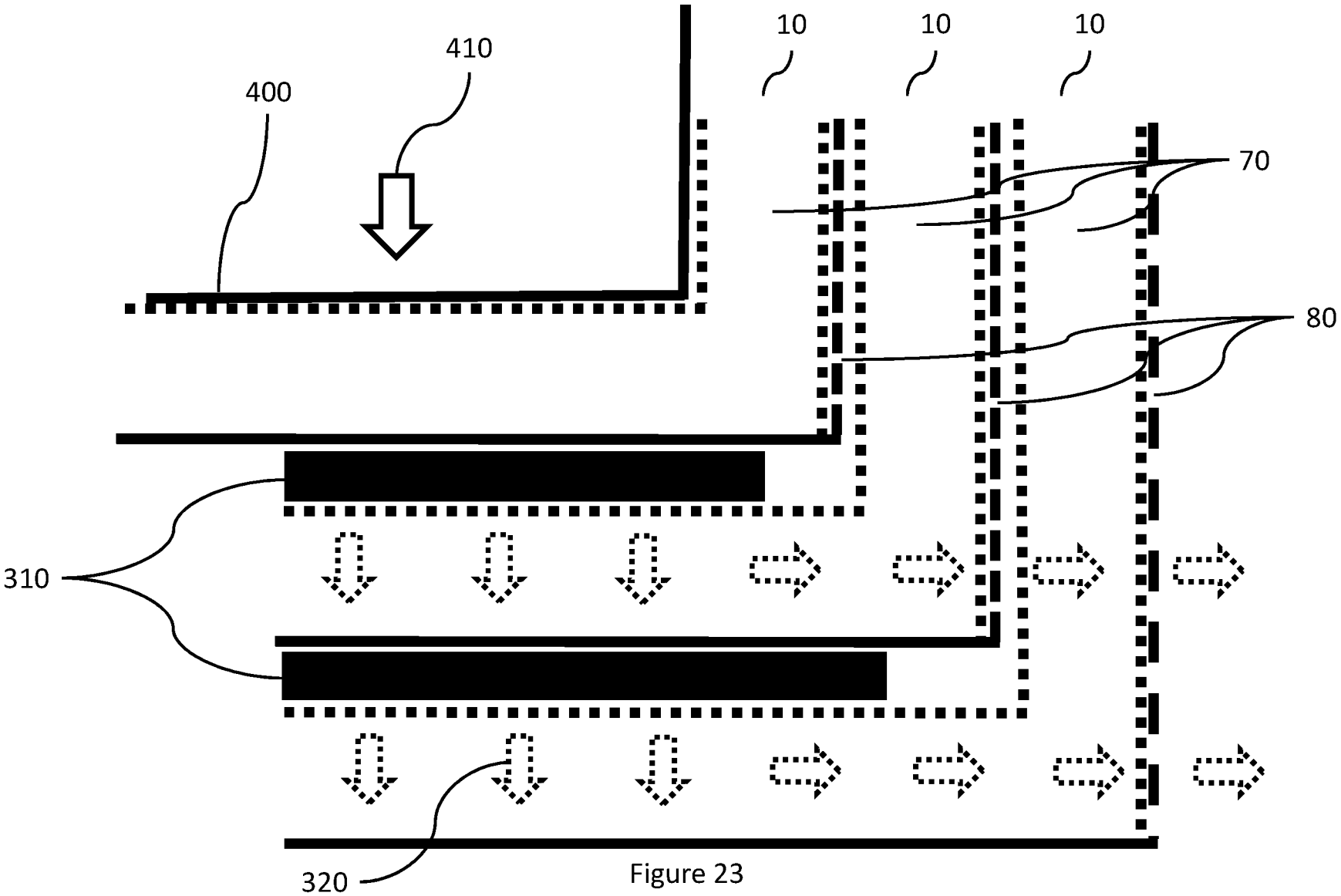
FIG. 23 is a schematic cross sectional view of components of the toilet according to the present invention.

As ram 400 compresses the feces 310 between the first and second bags 10, the ram 400 will squeeze liquid out of the feces 310 and downward into the filter 70 of the first bag 10. This compaction pressure accelerates the removal of liquid from feces 310, because it adds a squeezing action. FIG. 21 shows a closeup cross section of the ram 400 pressing on the second bag 10 and forcing the second bag 10 into the feces 310 in the first bag 10. Liquid squeezed out of feces 310 by ram 400 flows downward into the filter 70 of the first bag 10. The liquid then moves across the filter 70 of the first bag 10 to finally exit the bag at the perforations 80 in the side walls 20 of the first bag 10. The liquid from the feces 310 does not flow upward into the second bag 10 while the feces 310 is being squeezed, because the bottom side 30 of the second bag 10 is a continuous plastic sheet and has no perforations to allow the liquid to flow upward. Once the ram 400 of compactor 100 has completed its cycle to compress the feces 310, the user deflates ram 400. As ram 400 deflates it withdraws from the interior of the second bag 10 so that the receptacle 100 is ready for use with the second bag 10. FIG. 22 shows feces 310 is deposited into the second bag 10 and a third bag 10 placed inside the second bag 10 by the user. FIG. 23 shows a closeup of the ram 400 squeezing liquid from the feces 310 in the second bag 10 and how the liquid flows through the filters 70 and out through the perforations 80 of the second bag 10. The typical pressure that ram 400 would exert on feces 310 contained in bag 10 is about 10-30 psi depending on the amount of compaction desired. For a balloon ram to exert this much pressure would require the wall thickness of the balloon to be around 0.05-0.50 inches thick, but it could be thicker or thinner than this range.

The toilet could be designed to use either gases (for example air or carbon dioxide) or liquids (such as water or oil) to move the balloon or other type of piston type ram toward the bag 10 to exert pressure on bag 10. Any of these liquids or gases could be pumped into the ram 400 using a manual pump or an electric or gas-powered pump. Alternatively, the pressure could be built up in hydraulic fluid system using a hand lever similar to how many hydraulic jacks for cars work. For gases such as air, a manual pump or an electric pump could be used to increase the air pressure. A pressurized tank of the gas could inflate the balloon ram or drive the piston ram. For example, a tank for holding compressed gas could be filled with compressed carbon dioxide or compressed air at an automobile service station and then this tank could be taken to a remote site and connected to the toilet with a pressure hose. When the user presses a button on the toilet, the compressed gas from the pressurized tank would fill the balloon or piston ram to force it into the bag 10.

Figure 24:
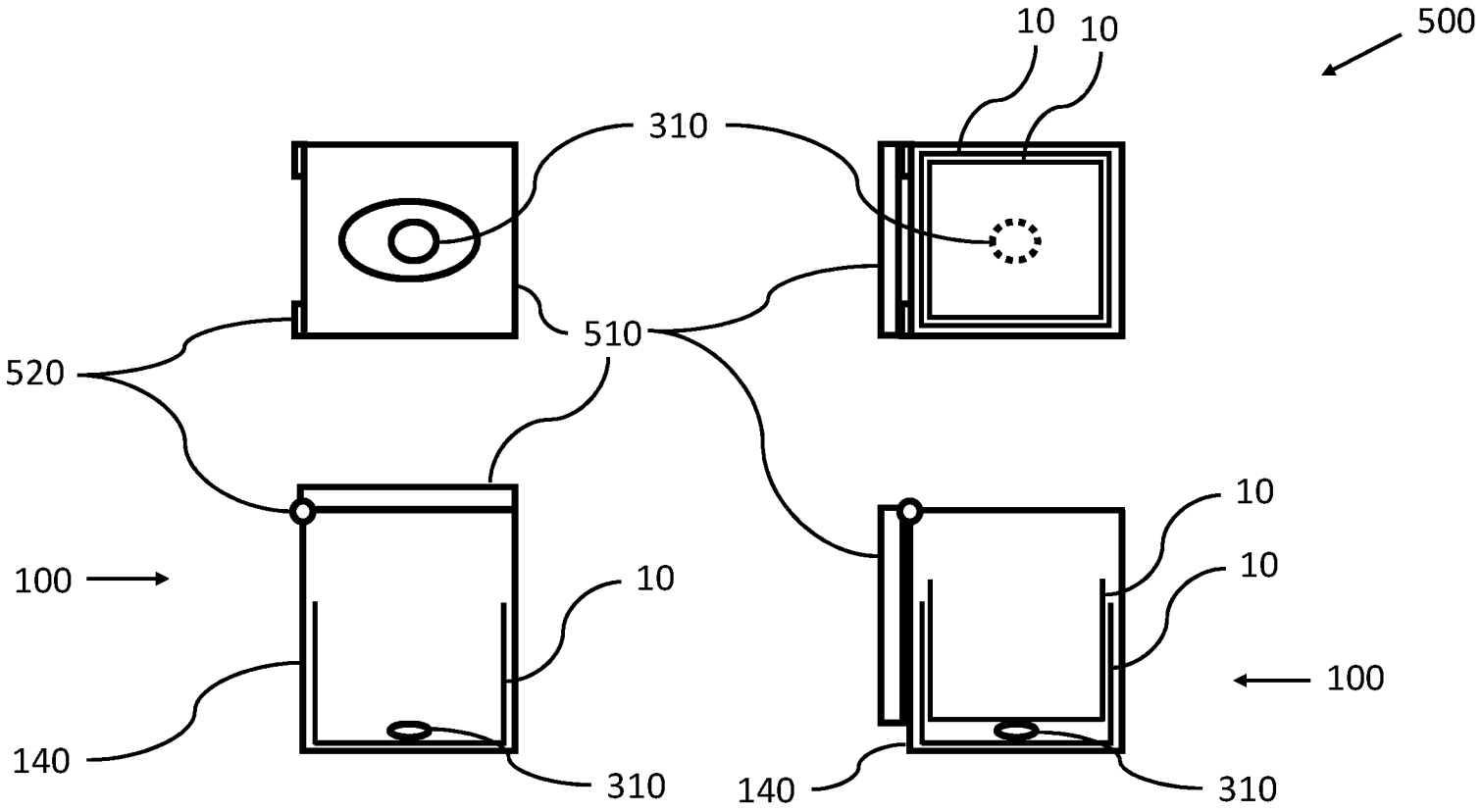
FIG. 24 is a schematic cross sectional view of components of the toilet according to the present invention.

FIG. 24 shows a simple toilet. Toilet 500 has a the receptacle 100 that is rectangular in shape and is approximately 1.5×1.5×2 feet in size and a lid 510 which can be rotated on hinges 520. For simplicity the slope of the bottom side of the tank, the drain and the liquid storage containers of the receptacle 100 have been omitted from the drawings. Lid 510 has an oval shaped hole in it that is typical of a toilet seat found in a common household toilet. The top and side views of the toilet 500 on the left of FIG. 24 show lid 510 in the closed position where lid is resting on top of the receptacle 100 and covering the open top side of the receptacle 100. In this position, the lid 510 forms the toilet seat of toilet 500 and allows the user to sit over the receptacle 100 to use the toilet. The top and side views of the toilet 500 on the right of FIG. 24 show lid 510 in the open position, where the lid is hanging on hinges 520 on the side of the receptacle 100. FIG. 24 also shows a portion of the operation of toilet 500. The top and side views of the toilet 500 on the left of FIG. 24 show that a first bag 10 has been inserted and sealed in the receptacle 100, whereby the filter layer, adhesive and perforations of the bags 10 were omitted from the FIG. 24 for simplicity. The lid 510 has then been rotated to the closed position and the user has defecated into the first bag 10. The top and side views of the toilet 500 on the right of FIG. 24 show lid 510 has been rotated to the open position and is hanging on hinges 520 on the side of the receptacle 100. The user has inserted a second bag 10 into the first bag 10 to rest on the feces in the first bag 10 and sealed the second bag 10 to the first bag 10. Without the ram system, the user would continue the process of defecating and inserting more bags 10 until the toilet fills at which point the bags 10 would need to be removed. In this most basic toilet, there is no mechanism to apply external pressure, so it relies on the weight of the subsequently deposited feces to flatten the previously deposited feces.

Figure 25:
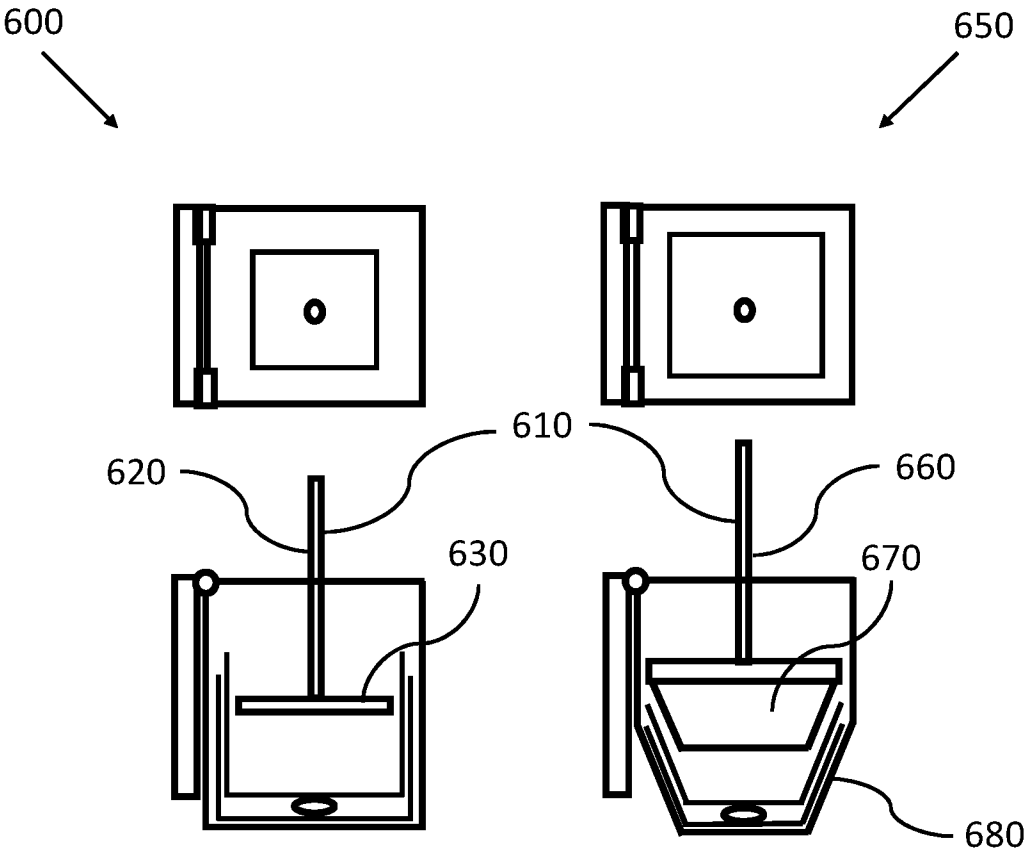
FIG. 25 is a schematic cross sectional view of components of the toilet according to the present invention.

FIG. 25 shows two types of toilets by which the user can apply pressure to the feces to compact and remove liquid more completely from the feces. The top and side views on the left of FIG. 25 show a manual ram 610 that has a handle 620 and a rectangular plate 630 attached perpendicular to handle 610 at one end of handle 610. Once the user has defecated into the first bag 10 and inserted the second bag 10 as was shown on the right-hand side of FIG. 24, the user then holds the manual ram 610 by handle 620 and pushes ram 610 down into the second bag 10 so that plate 620 flattens and squeezes liquid from the feces 310 in the first bag 10. The top and side views of toilet 650 on the right of FIG. 25 show how manual ram 610 and the receptacle 100 can be shaped so that when ram 610 is pushed down into the second bag 10 the ram 610 can also apply force to the sides of the bags 10 and force the adhesives on the sides of the bags 10 to adhere the bags together and to the side of the receptacle 100. Ram 610 in this case has a sloped plate 670 attached to handle 660 that matches the sloped bottom side 680 of the receptacle 100.

Figure 26:
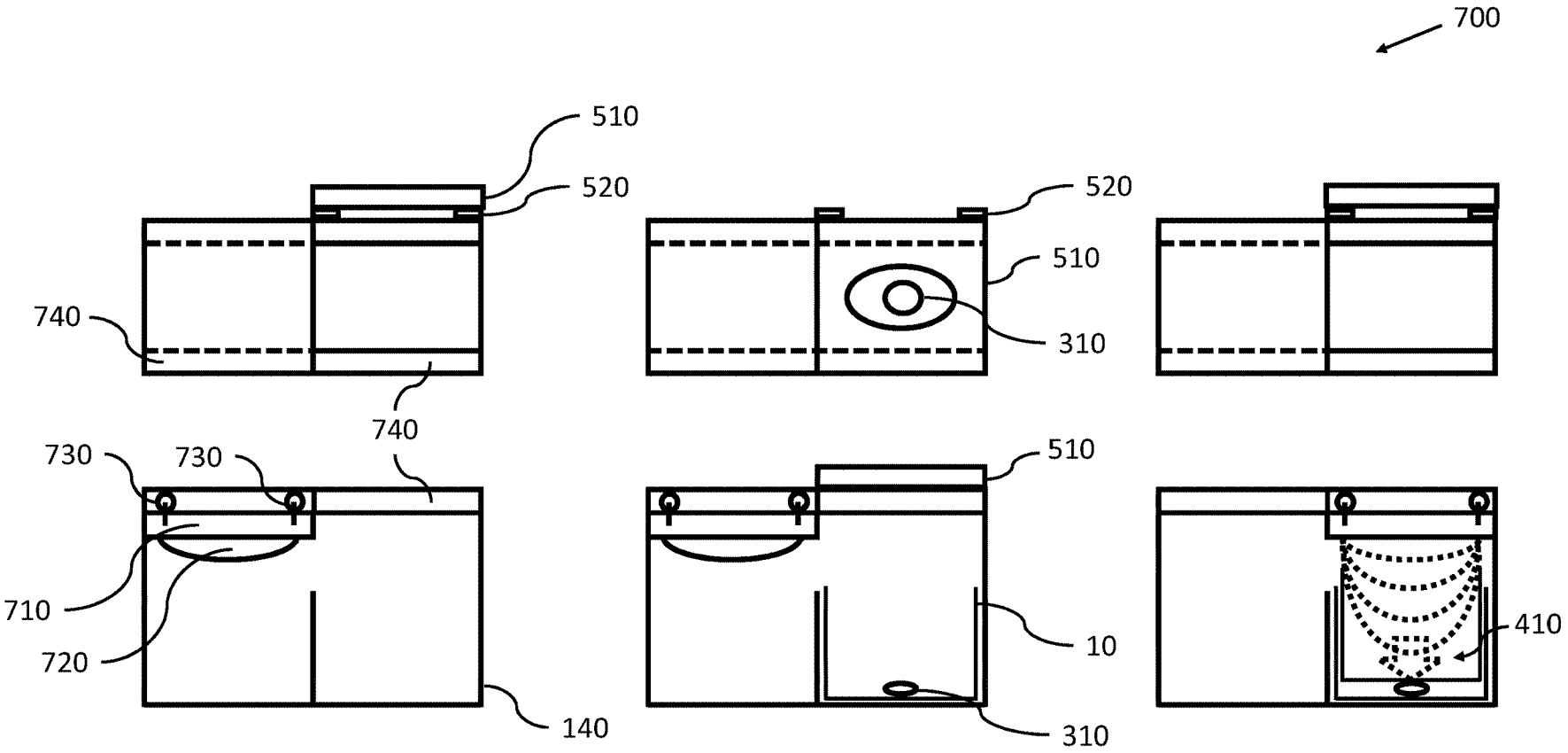

FIG. 26 shows a top and side view of another example of a toilet 700 in three stages of operation. Toilet 700 has a rubber balloon ram 720 attached to ram base 710 which hangs from rails 740 by wheels 730 attached to ram base 710, as shown on the left side of the FIG. 26. The wheels 730 allow the ram base with the attached rubber balloon ram 720 to be moved from a storage position shown on the left to a compaction position shown in the right side of the FIG. 26. The left side of the FIG. 26 shows toilet 700 with its lid 510 open and hanging by hinges 520 on the side of the receptacle 100. In this stage the toilet is ready for the user to load the first bag 10 into the receptacle 100. The top and side view of toilet 700 in the middle of FIG. 26 show that a user has inserted and sealed the first bag 10, closed the lid 510 and defecated into the first bag 10. The top and side view of toilet 700 on the right side of the FIG. 26 show that after defecation, the user has opened lid 510 and inserted a second bag 10 into the first bag 10 to rest on feces 310 in the first bag 10. The user then moved the ram base 710 with the rubber balloon ram 720 into place over the bags 10 by manually pushing it along the rails and then manually operates a hand or foot pump to inflate the rubber balloon ram 720. As the rubber balloon ram inflates it will eventually apply force 410 through the second bag 10 to the feces 310 in the first bag 10 to flatten and squeeze liquid out of feces 310 in the first bag 10. After compaction of the feces 310 the user would manually deflate the rubber balloon ram 720 with a pressure release valve and then move ram base 710 back to the storage position. Toilet 700 is then ready for the next use.

Toilets 500, 600, 650 and 700 of FIGS. 24-26 are all completely manually operated and require no water, power, plumbing or installation. This allows use in remote areas where electrical power is not available or in very limited in supply, but requires the user to perform a number of manual steps. With the addition of a small amount of electrical power such as that supplied by a rechargeable battery, some of the steps of the toilet operation can be automated to make the toilet easier and less time consuming to use. For example, an electric motor could be added inside the ram base 710 of toilet 700 shown in FIG. 26 to move the ram base 710 along the rails for changing it from the storage to the compaction positions and back. An electric air pump could also be included into the ram base 710 to automatically inflate and deflate the rubber balloon ram 720. A controller could be added to the system so that after defecation and manual addition of the second bag 10 the user could press a button and the controller would move the rubber balloon ram 720 into place, inflate it, deflate it and move it back to the storage position. Further automation could be added to the toilet so that the bags 10 were automatically inserted into the receptacle 100 as needed. The toilets described can be designed to be completely manual, semiautomatic or fully automatic corresponding to no, low and moderate electrical power inputs respectively.

The following are other embodiments envisioned that incorporate different features to previously described toilets.

For example, rather than moving the ram linearly on a rail system the ram could be moved from storage to the compaction position and back by swinging it on a rotating arm attached to a vertical shaft. A metal piston could be used instead of an inflatable balloon as the ram. A metal piston could be designed with conical shaped ram to apply pressure toward the side walls of the bags 10 to seal them in addition to a downward force toward the bags 10 to compact the feces. For a manual version of the metal piston ram, the ram could be lowered using a wheel shaped handle that the user would spin to force a screw shaped shaft downward like a cider press. Alternatively, the ram could be moved downward by a ratcheting handle the user moves up and down the way some older style car jacks worked. To automate the piston ram, the toilet could have an electric motor to drive the ram up and down during the compaction cycle and another to move the piston ram into and out of the compaction position. Additional functions could be added to make the toilet even easier to use. For example, compactor 100 could be designed so that the processed liquid accumulating in container 180 is evaporated to the outside air, so that the user would not need to empty liquid accumulated. To evaporate the liquid out of container 180 quickly enough to prevent the container 180 from overflowing, heat could be added to container 180 to cause evaporation. For example, compactor 100 could have an electric heating coil in near or in the container 180. Container 180 would then be heated to a high temperature using the heating coil. Compactor 100 could be designed in other ways to heat the processed liquid held in container 180 rather than using electrical resistance elements. For example, an induction heating element could be used similar to that used on some modern kitchen ranges. A propane gas burner could be used to heat container 180. Alternatively, the processed liquid in container 180 could be heated by blowing heated air on the water rather than heating container 180. Compactor 100 could also be designed to be more effective at removing water from the feces. For example, electrical resistance heating elements could be added to the tank to keep the feces heated to a temperature such as 50-100F, so that the feces are softened and compress more easily. A suction function could be added to the tank to draw water out of the feces faster. A biodegradable material could be used for the bag 10 and filters, so that the bags 10 with the compacted feces could be dumped directly into a composting pile.

The embodiments of the toilet do not increase the volume and weight of the human waste by adding water or compost to it. The toilet reduces the volume and weight of the waste by dehydrating the waste while it is contained in the plastic bag. The toilet contains and seals the waste, dehydrates the waste, and then processes liquid to be removed from the waste. Since the toilet processes liquid from the waste, the disposal of the processed liquid is much easier, simpler and more pleasant than emptying waste water from a black tank or cartridge toilet. After dehydration, the compacted dried residual solid waste that is sealed in plastic bags will provide for much easier storage and disposal. Because the human waste is compacted down into a very small weight and volume due to the removal of water from the waste products the toilet can be can be used many times before the accumulated bags 10 need to be removed from the toilet and disposed of. Applications for this invention would be for camping including truck campers, travel trailers and large RVs and even tents. It could be used in tractor trailer trucks which typically have no bathrooms and it could also be made portable enough to take in cars, vans or SUVs for emergencies.

In addition to mobile applications, the toilet can be used in stationary settings such as modular homes, cabins and tiny houses designed for off grid living. In these remote settings, use of the toilet would provide for a more pleasant experience because it could be used indoors in any room rather than using an outhouse where the user is exposed to insects, wide temperature variations as well as substantial odors. The toilets could be used in cities and villages in developing countries such as India where in some major inner city slums the human waste is deposited directly into open sewers that run along the streets. In these homes the toilet could be used to processes the waste liquid before it is released from the house into the sewer, which would greatly improve the sanitary conditions and consequently the health of the people living in them. In addition to toilets, there could be other applications for waste disposal where the waste products are mostly composed of water such as food waste at home or in a cafeteria to reduce the volume and weight of those wastes before disposal.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A toilet adapted to deposit solid and liquid waste, comprising:

a bag having closed side walls, closed bottom and open top, said side walls and bottom joined at edges to form a continuous enclosed interior and an exterior in order to collect the solid and liquid waste in said interior of said bag;

a filter attached to an interior surface of said bottom of said bag, said filter of a porous material that is adapted to allow the liquid waste to flow through said filter while trapping and removing unwanted particles and contaminants from the liquid waste;

perforations in said side walls of said bag adjacent to said filter to allow the liquid waste processed through said filter to flow from said bag;

a compactor bag receptacle having closed side walls, closed bottom and an open top, said side walls and bottom joined at edges to form a tank with an open top to receive said bag, said receptacle shaped to receive said bag and provide support for said bag.

2. The toilet of claim 1, further including at least one of another of said bag including said filter and said perforations to be placed inside of a proceeding bag already installed into said receptacle to cover and seal off the solid and liquid waste.

3. The toilet of claim 2, further including a pressure sensitive adhesive attached to said side walls on said exterior of said bag for attachment of said exterior of said bag to an interior of said receptacle and interior of another of said bag when said another bag is placed inside of a proceeding bag, said pressure sensitive adhesive providing a seal between an exterior of said bag with said pressure sensitive adhesive and said interior of said receptacle and interior of other of said bag.

4. The toilet of claim 1, wherein there is a sloped surface with the center higher than the edges to form an interior surface of said bottom of said receptacle to ensure that the liquid runs from said center toward said edges.

5. The toilet of claim 1, wherein said interior of said receptacle has a drain to receive the liquid waste from said perforations of said bag, said drain connected to a collection container for receiving, storage and removal of the liquid waste accumulating from said bag.

6. The toilet of claim 1, wherein said filter contains chemicals to treat the liquid waste.

7. The toilet of claim 2, further including a ram to provide external pressure to be exerted on the solid and liquid waste sealed off between said bags in order to compact the solid waste and squeeze out the liquid waste.

8. The toilet of claim 3, further including a ram to provide external pressure to be exerted on the solid and liquid waste sealed off between said bags in order to compact the solid waste and squeeze out the liquid waste.

9. The toilet of claim 8, wherein said ram is an inflatable material and wherein inflation of said ram imparts required pressure to compact the solid waste.

10. The toilet of claim 8, wherein said ram is shaped to force said another bag within said previous bag.

11. The toilet of claim 8, wherein said ram is shaped to force said pressure adhesive of said bag against said interior of said receptacle to mount said bag in said receptacle and provide a seal about said receptacle between said bag and said receptacle.

12. The toilet of claim 10, wherein said ram is shaped to force said pressure adhesive of said bag against said interior of said previous bag to mount said another bag in said previous bag and said receptacle in order to provide a seal about said previous bag between said another bag and said previous bag.

13. The toilet of claim 8, wherein said ram has a handle to manually apply said external pressure.

14. The toilet of claim 8, wherein said ram has a mechanical device to apply said external pressure.

15. The toilet of claim 14, wherein said mechanical device has a motor to apply said external pressure.

16. The toilet of claim 5, wherein said collection container has a heat source to evaporate the processed liquid waste in said collection container.

* * * * *